US010766733B2

(12) United States Patent
Takada

(10) Patent No.: US 10,766,733 B2
(45) Date of Patent: Sep. 8, 2020

(54) ELECTRIC WIRE PROCESSING APPARATUS, ELECTRIC WIRE PROCESSING METHOD, AND ELECTRIC WIRE HOLDING STRUCTURE

(71) Applicant: Yazaki Corporation, Minato-ku, Tokyo (JP)

(72) Inventor: Kazuhiko Takada, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 182 days.

(21) Appl. No.: 15/912,649

(22) Filed: Mar. 6, 2018

(65) Prior Publication Data

US 2018/0257903 A1 Sep. 13, 2018

(30) Foreign Application Priority Data

Mar. 8, 2017 (JP) ..... 2017-043675

(51) Int. Cl.
*B65H 54/58* (2006.01)
*H01B 13/012* (2006.01)
(Continued)

(52) U.S. Cl.
CPC ..... *B65H 54/58* (2013.01); *B65H 51/14* (2013.01); *B65H 51/18* (2013.01); *B65H 57/16* (2013.01);
(Continued)

(58) Field of Classification Search
CPC ..... B65H 51/14; B65H 51/18; B65H 54/58; B65H 54/62; B65H 65/00; B65H 75/28;
(Continued)

(56) References Cited

U.S. PATENT DOCUMENTS 6,948,675 B2 * 9/2005 Frommenwiler ..... B65H 54/56 242/362.2

FOREIGN PATENT DOCUMENTS

EP 2790191 A1 10/2014
JP S56-150789 U 11/1981
(Continued)

OTHER PUBLICATIONS

Jan. 15, 2019—(JP) Notification of Reasons for Refusal—App 2017-043675.

*Primary Examiner* — William E Dondero
(74) *Attorney, Agent, or Firm* — Banner & Witcoff, Ltd.

(57) ABSTRACT

An electric wire processing apparatus includes a gripping mechanism that grips a part of an electric wire, a driving mechanism that drives the gripping mechanism, an electric wire winding mechanism that winds the electric wire, and a rotating mechanism that rotates and drives the electric wire winding mechanism. The electric wire winding mechanism includes a winding drum, an electric wire clip provided on the winding drum to hold a leading end of the electric wire, and a holding member that holds an electric wire bundle. The driving mechanism moves the gripping mechanism toward the electric wire clip to hold the leading end on the electric wire clip, the rotating mechanism rotates the winding drum so that the electric wire is wound around the winding drum, and the holding member holds the electric wire bundle wound around the winding drum in the annular shape.

9 Claims, 43 Drawing Sheets

(51) Int. Cl.

| | |
|---|---|
| ***B65H 75/28*** | (2006.01) |
| ***B65H 51/14*** | (2006.01) |
| ***B65H 51/18*** | (2006.01) |
| ***B65H 65/00*** | (2006.01) |
| ***B65H 57/16*** | (2006.01) |
| ***H01R 43/28*** | (2006.01) |

(52) U.S. Cl.
CPC ..... *B65H 65/00* (2013.01); *B65H 75/28* (2013.01); *H01B 13/01209* (2013.01); *B65H 2701/34* (2013.01); *H01B 13/01236* (2013.01); *H01R 43/28* (2013.01)

(58) Field of Classification Search
CPC ..... H01B 13/0036; H01B 13/01209; H01B 13/01236; H01R 43/00; H01R 43/28
USPC ..... 242/472.5
See application file for complete search history.

(56) References Cited

FOREIGN PATENT DOCUMENTS

| | | | |
|---|---|---|---|
| JP | H07-192550 | A | 7/1995 |
| JP | H11-228026 | A | 8/1999 |
| JP | 2004-256300 | A | 9/2004 |
| JP | 2009-004233 | A | 1/2009 |
| JP | 2010-092788 | A | 4/2010 |
| JP | 2010-287369 | A | 12/2010 |
| JP | 2011-216363 | A | 10/2011 |
| JP | 2012-104425 | A | 5/2012 |
| JP | 2013-152856 | A | 8/2013 |

* cited by examiner

ELECTRIC WIRE PROCESSING APPARATUS, ELECTRIC WIRE PROCESSING METHOD, AND ELECTRIC WIRE HOLDING STRUCTURE

CROSS REFERENCE TO RELATED APPLICATION

This application is based on Japanese Patent Application No. 2017-043675 filed on Mar. 8, 2017, the contents of which are incorporated herein by reference.

BACKGROUND OF THE INVENTION

1. Technical Field

The present invention relates to an electric wire processing apparatus and an electric wire processing method for processing an electric wire, and relates to an electric wire holding structure used in the electric wire processing apparatus and the electric wire processing method.

2. Background Art

In a process of processing an electric wire used for a wire harness, a technique for holding a plurality of electric wires in an electric wire holding bar is disclosed in JP-A-2010-92788. A technique for sequentially conveying a plurality of electric wire holding bars to a supply position of an electric wire with terminal is disclosed in JP-A-2010-287369 and JP-A-2013-152856.

Further, an electric wire sorting apparatus for sorting electric wires processed by an electric wire processing machine and an electric wire accommodating apparatus for accommodating electric wires after treatment with an electric wire processing apparatus are disclosed in JP-A-2012-104425 and JP-A-2011-216363.

In JP-A-2010-92788, JP-A-2010-287369, JP-A-2013-152856, JP-A-2012-104425, and JP-A-2011-216363 described above, a technique of manufacturing a wire harness is disclosed on the premise that an electric wire of a normal length of about 2 m is processed. In the case of manufacturing a wire harness using a long electric wire longer than the electric wire of a normal length, there is a process performed manually by a worker, and there is room for improving productivity in such a process.

An example of the above-described process performed manually is as follows. That is, a process of pulling the electric wire out of a reel and processing it into a long electric wire of a predetermined length is automatically performed in the related art, but the worker conveys the electric wire to an automatic machine, which performs the next process (stripping of a sheath, crimping of a terminal, or the like) of processing the electric wire. The worker winds the long electric wire in an annular shape and conveys it to the automatic machine with a shape and a size suitable for the conveyance.

The invention has been made in view of the above circumstances, and an object thereof is to provide an electric wire processing apparatus and an electric wire processing method which contribute to improvement in productivity in a case of conveying a long electric wire to an automatic machine for processing an electric wire, and to provide an electric wire holding structure used in the electric wire processing apparatus and the electric wire processing method.

SUMMARY OF THE INVENTION in order to achieve the above-described object, an electric wire processing apparatus according to the invention is characterized by the following configurations (1) to (6), (1) An electric wire processing apparatus includes:

a gripping mechanism that is capable of gripping a part of an electric wire;

a driving mechanism that drives the gripping mechanism;

an electric wire winding mechanism that winds the electric wire; and a rotating mechanism that rotates and drives the electric wire winding mechanism, wherein the electric wire winding mechanism includes a winding drum on which the electric wire is wound, an electric wire clip provided on the winding drum to hold a leading end of the electric wire, and a holding member that holds an electric wire bundle wound around the winding drum in an annular shape, the driving mechanism moves the gripping mechanism, which grips the leading end of the electric wire, toward the electric wire clip to hold the leading end on the electric wire clip, the rotating mechanism rotates the winding drum in a state where the leading end of the electric wire is held on the electric wire clip so that the electric wire is wound around the winding drum, and the holding member holds the electric wire bundle wound around the winding drum in the annular shape.

(2) The electric wire processing apparatus of (1) further includes:

an electric wire cutting device that cuts the electric wire to a predetermined length and feeds the cut electric wire; and an electric wire extracting device that receives the electric wire fed from the electric wire cutting device, wherein the electric wire cutting device includes a first gripping mechanism serving as the gripping mechanism, the electric wire extracting device includes a second gripping mechanism serving as the gripping mechanism, a second driving mechanism that drives the second gripping mechanism and serves as the driving mechanism, the electric wire winding mechanism, and the rotating mechanism, the first gripping mechanism grips the leading end of the electric wire fed by the electric wire cutting device when the leading end is fed, the second gripping mechanism grips the leading end and receives the electric wire when the first gripping mechanism grips the leading end of the electric wire, and the second driving mechanism moves the second gripping mechanism, which grips the leading end of the electric wire, toward the electric wire clip to hold the leading end on the electric wire clip.

(3) In the electric wire processing apparatus of (2), the electric wire cutting device further includes a first driving mechanism that drives the first gripping mechanism and serves as the driving mechanism, and the first driving mechanism drives the first gripping mechanism so that a direction of the leading end of the electric wire gripped by the first gripping mechanism is reversed from a forward feeding direction of the electric wire cutting device to a reverse feeding direction of the electric wire cutting device.

(4) In the electric wire processing apparatus of any one of (1) to (3), the winding drum includes a hollow cylindrical body around which the electric wire is wound, the cylindrical body is provided with a notch which is recessed downward in an axial direction of the cylindrical body from an upper end of the cylindrical body in the axial direction, and the electric wire clip is accommodated and attached in the notch so that an electric wire pinching direction coincides with a radial direction of the cylindrical body.

(5) In the electric wire processing apparatus of (4), the driving mechanism rotates the gripping mechanism, which grips the leading end of the electric wire, to be in a state where the leading end of the electric wire is inclined with respect to a plane orthogonal to the axial direction of the cylindrical body, and moves the gripping mechanism toward the electric wire clip.

(6) In the electric wire processing apparatus of (4), the driving mechanism rotates the gripping mechanism, which grips the leading end of the electric wire, to be in a state where the electric wire pinching direction of the electric wire clip is orthogonal to a direction in which the leading end of the electric wire extends, and moves the gripping mechanism toward the electric wire clip.

In order to achieve the above-described object, an electric wire processing method according to the invention is characterized by the following configurations (7) and (11).

(7) An electric wire processing method includes:

moving a gripping mechanism, which grips a leading end of an electric wire, toward an electric wire clip for holding the leading end of the electric wire to hold the leading end on the electric wire clip;

rotating a winding drum, on which the electric wire clip is provided, in a state where the leading end of the electric wire is held on the electric wire clip so that the electric wire is wound around the winding drum; and attaching a holding member to an electric wire bundle wound around the winding drum in the annular shape.

(8) The electric wire processing method of (7) further includes:

gripping the leading end of the electric wire fed by an electric wire cutting device, using a first gripping mechanism serving as the gripping mechanism included in the electric wire cutting device that cuts the electric wire to a predetermined length and feeds the cut electric wire, when the leading end is fed;

gripping the leading end and receives the electric wire, using a second gripping mechanism serving as the gripping mechanism included in an electric wire extracting device that receives the electric wire fed from the electric wire cutting device, when the first gripping mechanism grips the leading end of the electric wire; and moving the second gripping mechanism, which grips the leading end of the electric wire, toward the electric wire clip to hold the leading end on the electric wire clip.

(9) In the electric wire processing method of (8), the first gripping mechanism is driven so that a direction of the leading end of the electric wire gripped by the first gripping mechanism is reversed from a forward feeding direction of the electric wire cutting device to a reverse feeding direction of the electric wire cutting device.

(10) In the electric wire processing method of any one of (7) to (9), the winding drum includes a hollow cylindrical body around which the electric wire is wound, the cylindrical body is provided with a notch which is recessed downward in an axial direction from an upper end in the axial direction, and the electric wire clip is accommodated and attached in the notch, and the gripping mechanism, which grips the leading end of the electric wire, is rotated to be in a state where the leading end of the electric wire is inclined with respect to a plane orthogonal to the axial direction of the cylindrical body, and the gripping mechanism is moved toward the electric wire clip.

(11) In the electric wire processing method of any one of (7) to (9), the winding drum includes a hollow cylindrical body around which the electric wire is wound, the cylindrical body is provided with a notch which is recessed downward in an axial direction from an upper end in the axial direction, and the electric wire clip is accommodated and attached in the notch, and the gripping mechanism, which grips the leading end of the electric wire, is rotated to be in a state where an electric wire pinching direction of the electric wire clip is orthogonal to a direction in which the leading end of the electric wire extends, and the gripping mechanism is moved toward the electric wire clip.

In order to achieve the above-described object, an electric wire holding structure according to the invention is characterized by the following configurations (12) and (13).

(12) An electric wire holding structure includes:

an electric wire; and a holding member that holds an electric wire bundle, wherein the electric wire is wound several times to form an annular shape, and is held by the holding member to maintain the annular shape.

(13) In the electric wire holding structure of (12), the electric wire is held at three or more places by the holding member to maintain the annular shape.

According to the electric wire processing apparatus of the configuration (1), the electric wire processing method of the configuration (7), and the electric wire holding structure of the configuration (12), the electric wire is wound several times to form an annular shape, the electric wire is held at three or more places by the clamp, and thus the electric wire holding structure for maintaining the annular shape is completed. According to the electric wire holding structure for holding the electric wire, even in the case of manufacturing a wire harness using a long electric wire longer than a normal length, there is no need for the worker to deform the electric wire to have a shape and a size suitable for conveying the long electric wire to an automatic machine which processes the electric wire. Further, since the shape of the electric wire holding structure is maintained in the annular shape, the electric wire holding structure may be conveyed to the automatic machine for processing the electric wire by being hung on a hook, and thus the conveyance of the electric wire holding structure is also easily automated.

According to the electric wire processing apparatuses of the configurations (2) and (3) and the electric wire processing methods of the configurations (8) and (9), although existing equipment is used as the electric wire cutting device and a new equipment is used for the electric wire extracting device when the invention is performed, the invention c be applied to various electric wire cutting devices (existing equipment) when the electric wire extracting device processes the electric wire with the electric wire holding structure.

According to the electric wire processing apparatus of the configuration (4), when the electric wire clip holds the leading end of the electric wire, the leading end of the electric wire can be disposed in a state where the electric wire is wound side by side around the winding rib.

According to the electric wire processing apparatus of the configuration (5) and the electric wire processing method of the configuration (10), it is possible to maintain a state where a portion other than the leading end of the electric wire is located on the straight line through which the electric wire is fed by the electric wire feeding mechanism when the electric wire processing apparatus is viewed from the top. Thus, the position of the electric wire is prevented from being shifted every time the electric wire is wound around the winding drum.

According to the electric wire processing apparatus of the configuration (6) and the electric wire processing method of the configuration (11), the leading end of the electric wire can be easily pushed into the electric wire clip.

According to the electric wire holding structure of the configuration (13), when the electric wire bundle is held at a plurality of places, the electric wire can be maintained in an annular shape more similar to a circular shape.

According to the electric wire processing apparatus, the electric wire processing method, and the electric wire holding structure of the invention, it is possible to achieve an effect of contributing to productivity improvement in a case of conveying a long electric wire to an automatic machine.

The invention is briefly described above. Furthermore, the details of the invention will be further clarified by an embodiment to be described below with reference to the accompanying drawings.

DETAILED DESCRIPTION OF E EMBODIMENTS

A detailed embodiment of the invention will be described below with reference to each drawing.

Configuration of Electric Wire Processing Apparatus

Figure 1:
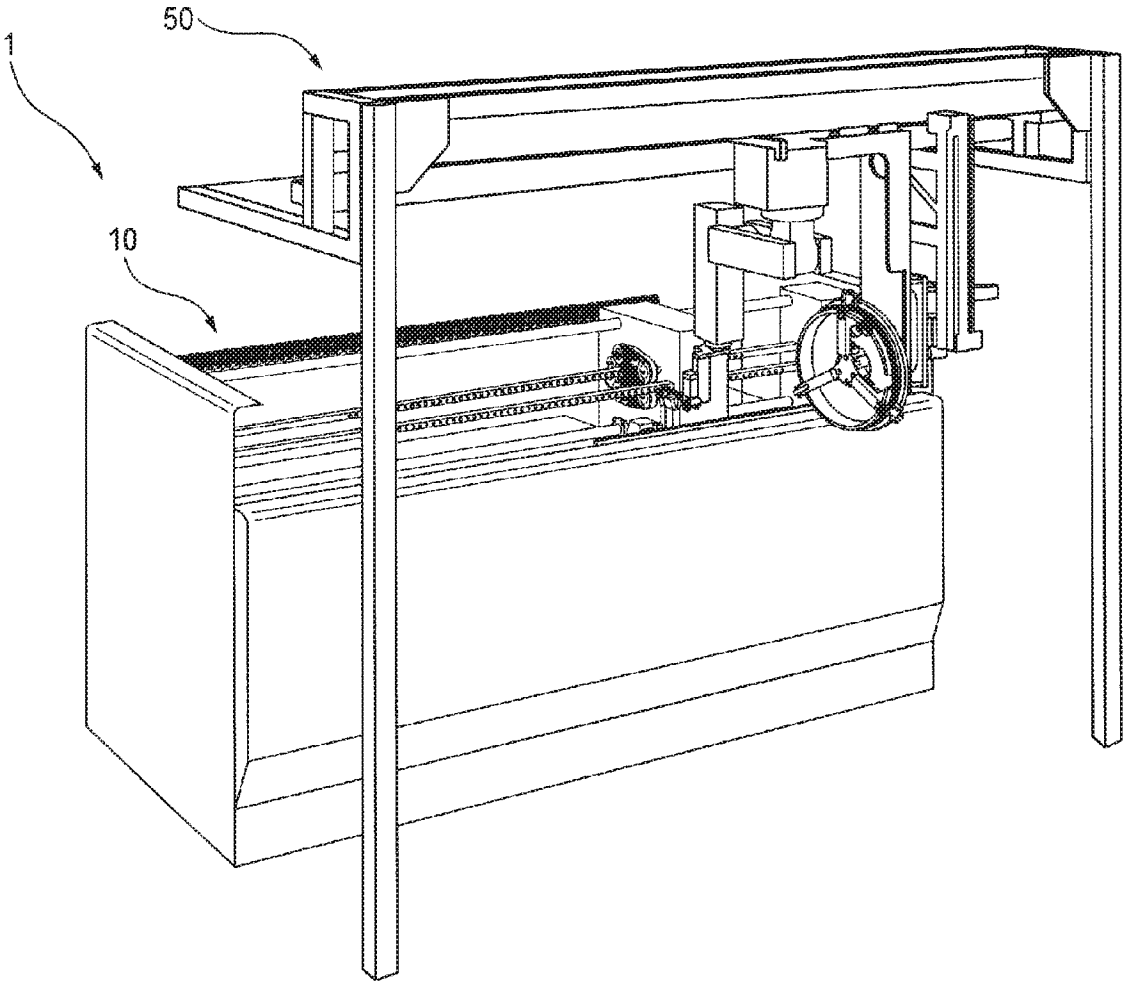
FIG. 1 is a perspective view illustrating an electric wire processing apparatus according to an embodiment of the invention.

FIG. 1 is a perspective view illustrating an electric wire processing apparatus according to the embodiment of the invention. An electric wire processing apparatus 1 according to the embodiment of the invention includes an electric wire cutting device 10 and an electric wire extracting device 50. The electric wire cutting device 10 is a device that draws an electric wire from electric wires wound on a reel and supplies the electric wire cut to a predetermined length to the electric wire extracting device 50. The electric wire extracting device 50 is a device that processes the electric wire of the predetermined length supplied from the electric wire cutting device 10 to have a shape and a size suitable for conveying to an automatic machine, which strips a sheath and crimps a terminal, using a manipulator to be controlled by a computer.

Figure 2:
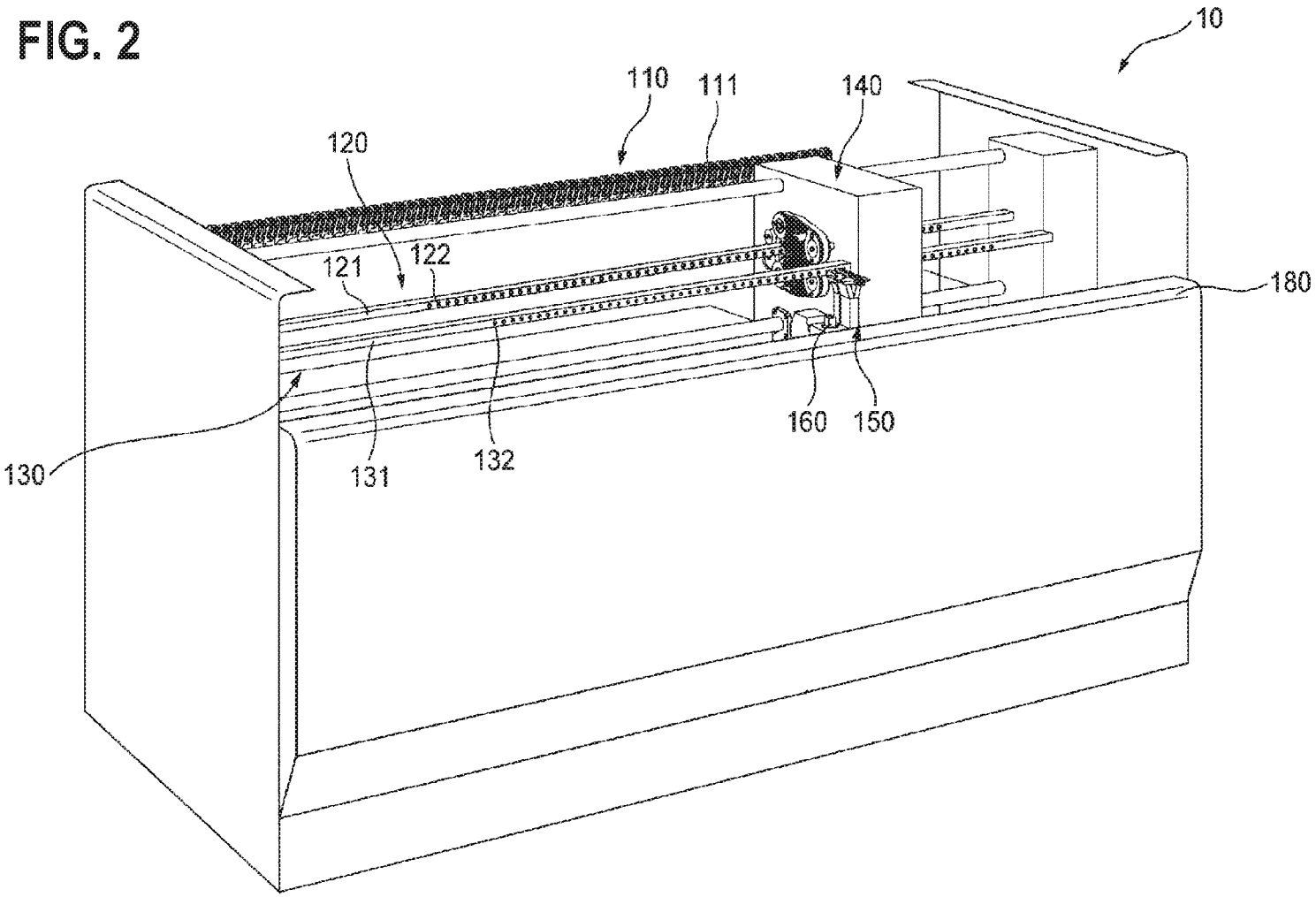
FIG. 2 is a perspective view illustrating an electric wire cutting device according to the embodiment of the invention.
Figure 3:
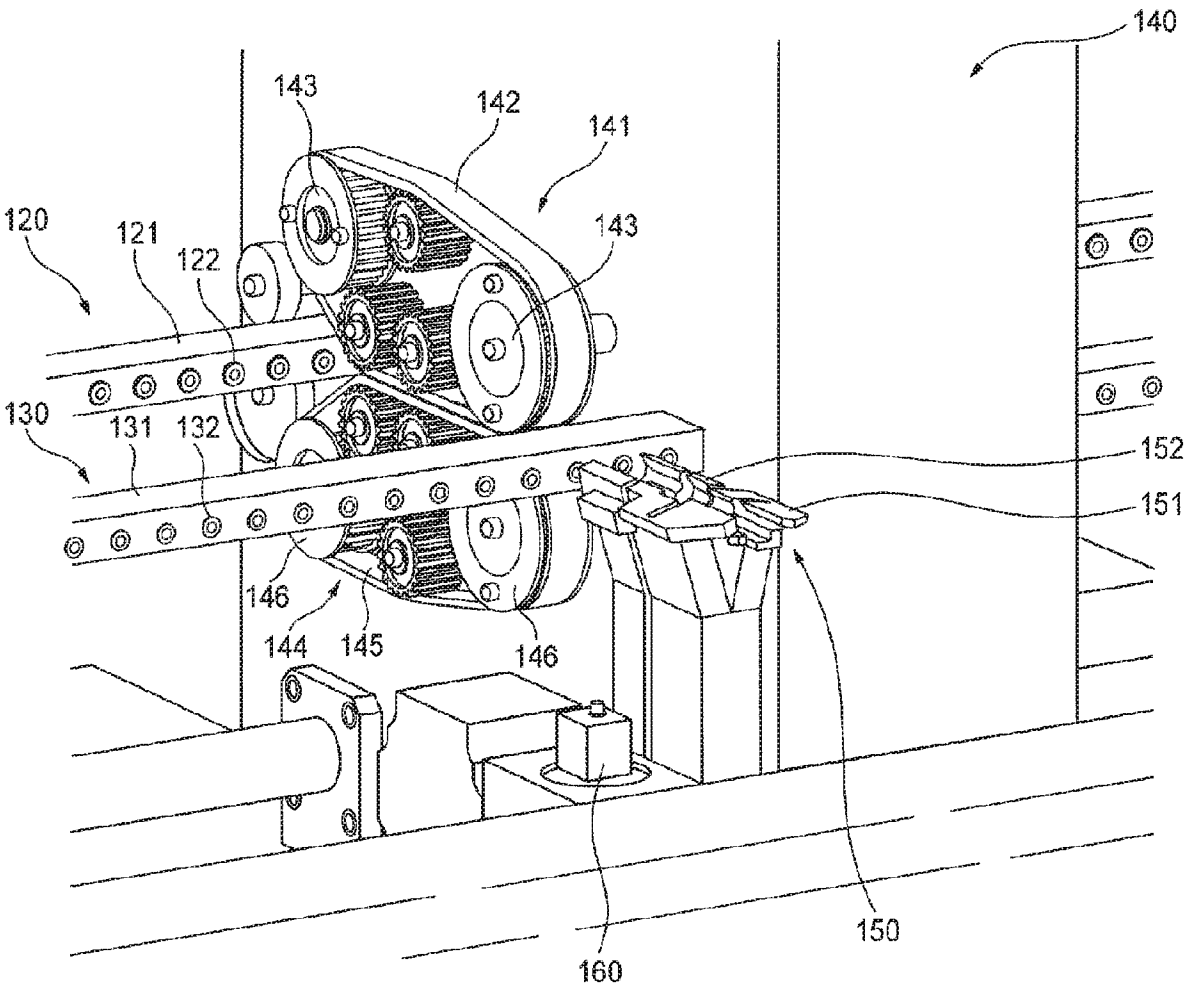
FIG. 3 is an enlarged perspective view illustrating a main part of the electric wire cutting device according to the embodiment of the invention.
Figure 4:
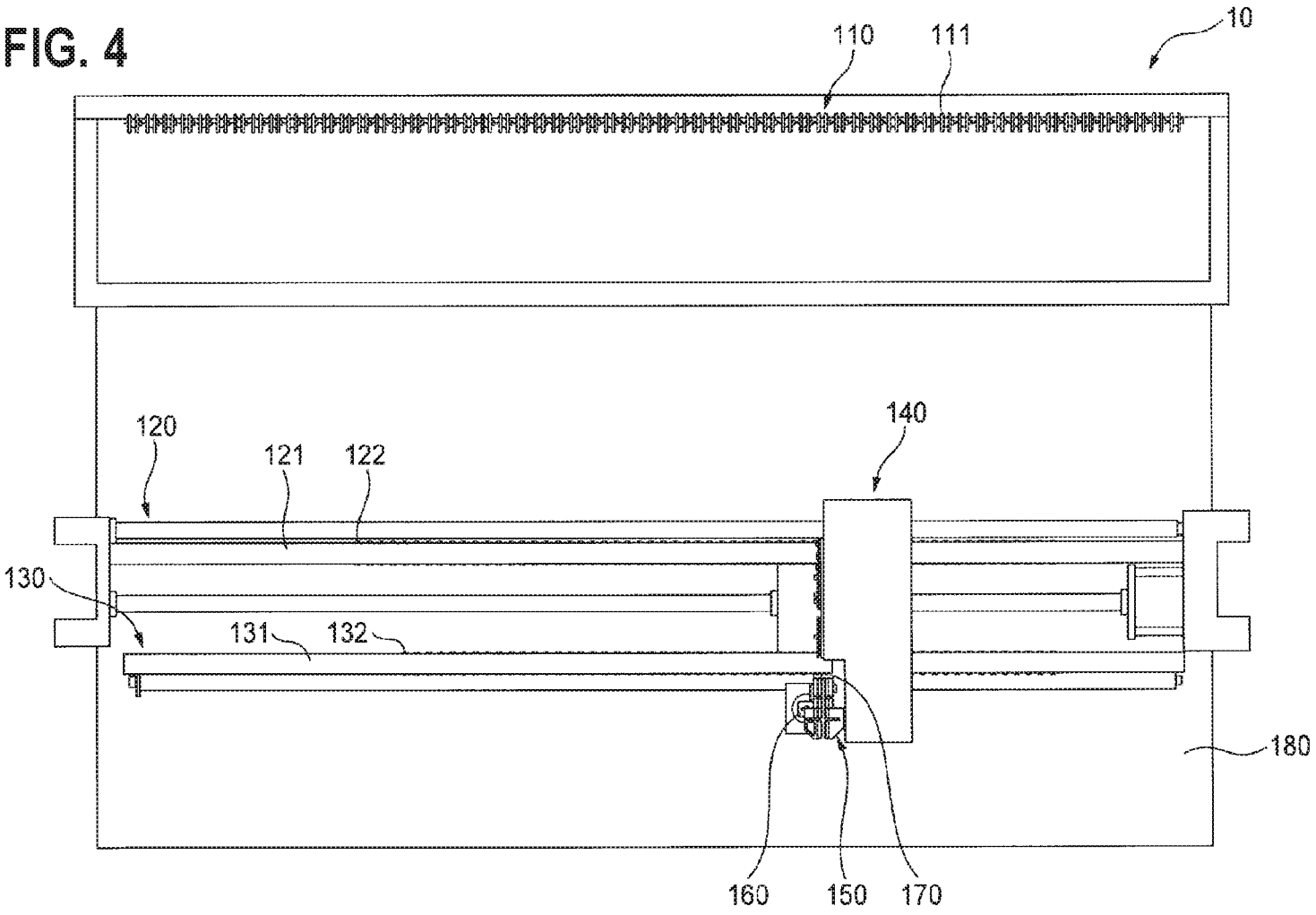
FIG. 4 is a plan view of the electric wire cutting device according to the embodiment of the invention.
Figure 5:
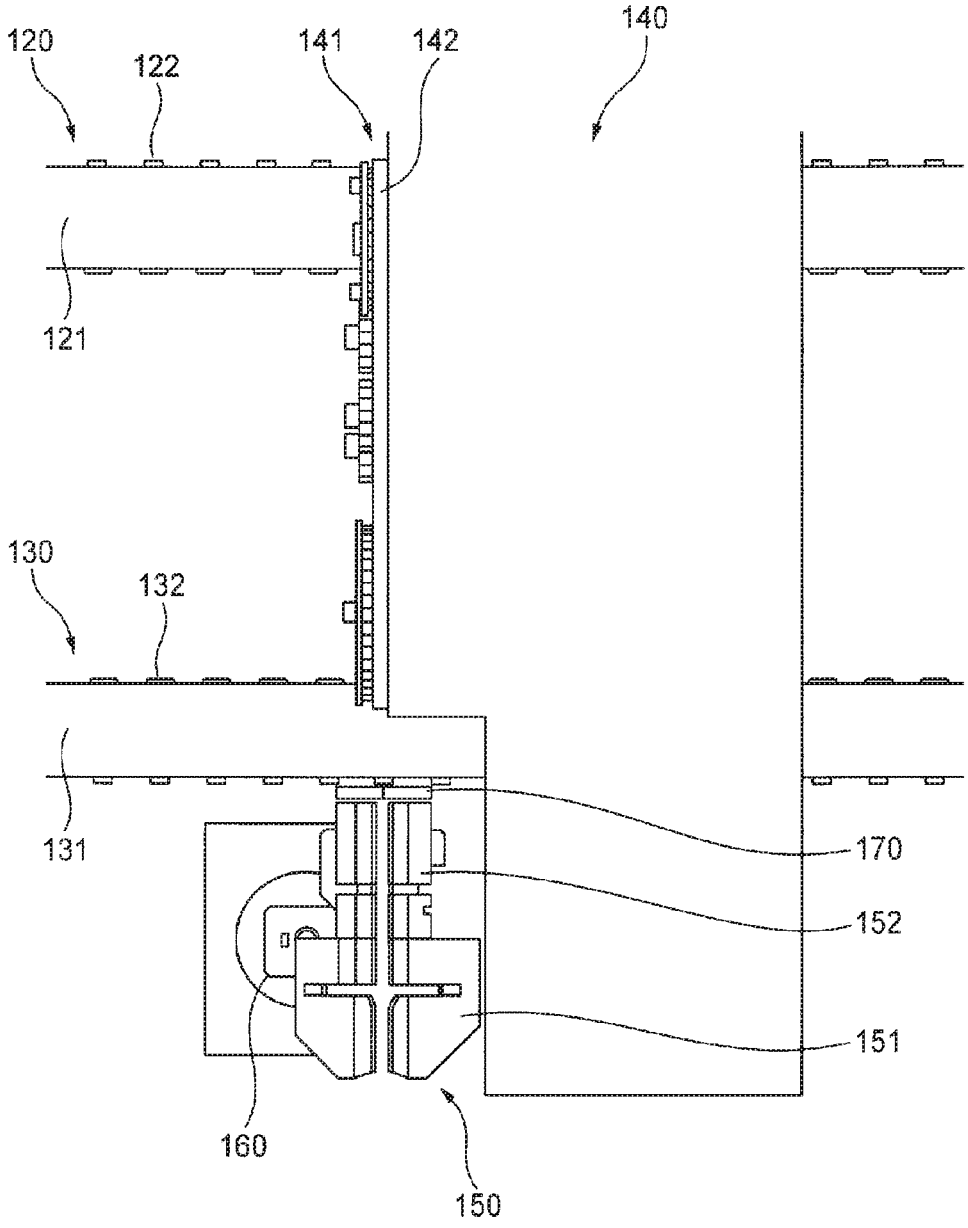
FIG. 5 is an enlarged plan view illustrating the main part of the electric wire cutting device according to the embodiment of the invention.

First, the electric wire cutting device 10 will be described in detail below with reference to FIGS. 2 to 5. FIG. 2 is a perspective view illustrating an electric wire cutting device according to the embodiment of the invention. FIG. 3 is an enlarged perspective view illustrating a main part of the electric wire cutting device according to the embodiment of the invention. FIG. 4 is a plan view of the electric wire cutting device according to the embodiment of the invention. FIG. 5 is an enlarged plan view illustrating the main part of the electric wire cutting device according to the embodiment of the invention.

The electric wire cutting device 10 is configured in which a first electric wire guide 110, a second electric wire guide 120, a third electric wire guide 130, an electric wire feeding mechanism 140, an electric wire gripping mechanism 150, a rotating mechanism 160, and an electric wire cutting mechanism 170 are fixed to a support frame 180.

The first electric wire guide 110 is a member that guides electric wires wound on a reel (not illustrated), which is disposed adjacent to the electric wire cutting device 10, to the electric wire cutting device 10. As illustrated in FIG. 2, the first electric wire guide 110 has a structure in which a plurality of disk members 111 having grooves formed along a circumferential direction are fixed to the support frame 180. The plurality of disk members 111 is disposed in a line so that adjacent grooves are aligned in parallel. The electric wire wound on the reel is drawn toward one of the plurality of disk members 111 and is guided to the groove of the disk member 111, thereby being disposed toward the electric wire cutting device 10.

The second electric wire guide 120 is a member that guides the electric wire guided by the first electric wire guide 110 toward the electric wire feeding mechanism 140. As illustrated in FIGS. 2 and 3, the second electric wire guide 120 includes a bar-shaped guide body 121 having a rectangular cross-section that is fixed to the support frame 180 in a direction substantially parallel to the direction in which the disk member 111 of the first electric wire guide 110 is disposed. The guide body 121 is formed with a plurality of guide holes 122 penetrating through the guide body 121. The guide hole 122 is perforated in the guide body 121 in a direction substantially perpendicular to a longitudinal direction of the guide body 121. The electric wire guided by the first electric wire guide 110 is inserted into the guide hole 122 and is guided to the guide hole 122, thereby being disposed toward the electric wire feeding mechanism 140.

The third electric wire guide 130 is a member that guides the electric wire guided by the second electric wire guide 120 toward the electric wire gripping mechanism 150. As illustrated in FIGS. 2 and 3, the third electric wire guide 130 includes a bar-shaped guide body 131 having a rectangular cross-section that is fixed to the support frame 180 in a direction substantially parallel to the longitudinal direction of the guide body 121 of the second electric wire guide 120. The guide body 131 is formed with a plurality of guide holes 132 penetrating through the guide body 131. The guide hole 132 is perforated in the guide body 131 in a direction substantially perpendicular to the longitudinal direction of the guide body 131. The electric wire guided by the second electric wire guide 120 is inserted into the guide hole 132 and is guided to the guide hole 132, thereby being disposed toward the electric wire gripping mechanism 150. In addition, each of the guide holes 132 is provided at a position facing each of the guide holes 122 of the second electric wire guide 120. Therefore, the electric wire located between the second electric wire guide 120 and the third electric wire guide 130 is disposed substantially perpendicular to the second electric wire guide 120 and the third electric wire guide 130.

The electric wire feeding mechanism 140 is a mechanism that feeds the electric wire toward the direction in which the electric wire gripping mechanism 150 is located, that is, toward a direction opposite to the first electric wire guide 110 in the electric wire cutting device 10. Specifically, as illustrated in FIG. 3, the electric wire feeding mechanism 140 includes an upper belt drive 141 configured with one annular belt 142 and a plurality of pulleys 143 meshed with an inner circumferential surface of the belt 142 and a lower belt drive 144 configured with one belt 145 and a plurality of pulleys 146 meshed with an inner circumferential surface of the belt 145. The upper belt drive 141 and the lower belt drive 144 are arranged such that a part of the belt 142 and a part of the belt 145 are in contact with each other and the contacting part is disposed between the second electric wire guide 120 and the third electric wire guide 130 and on a segment between the guide hole 122 and the guide hole 132 facing each other. Therefore, the electric wire feeding mechanism 140 can pinch the electric wire located between the second electric wire guide 120 and the third electric wire guide 130 at the contacting part between the belt 142 and the belt 145. The electric wire feeding mechanism 140 drives the upper belt drive 141 and the lower belt drive 144 to revolve them in opposite directions in a state where the electric wire is pinched, so that the electric wire can be fed in the direction in which the electric wire gripping mechanism 150 is located.

The electric wire gripping mechanism 150 is a member (may be referred to as a gripping mechanism) that grips a part of the electric wire guided by the third electric wire guide 130 and fed from the third electric wire guide 130. Specifically, as illustrated in FIG. 3, the electric wire gripping mechanism 150 includes a first chuck 151 located at a front side in the direction in which the electric wire is fed (hereinafter, may be referred to as a feeding direction) and a second chuck 152 located at a rear side in the feeding direction. Each of the first chuck 151 and the second chuck 152 includes a contact surface for gripping the electric wire at the front of the guide hole 132 of the third electric wire guide 130. For this reason, the electric wire gripping mechanism 150 can grip the electric wire guided and fed by the third electric wire guide 130 with the first chuck 151 and the second chuck 152.

The rotating mechanism 160 is a mechanism (may be referred to as a driving mechanism) that converts a leading end of the electric wire guided by the third electric wire guide 130 and extending in a forward feeding direction to a reverse feeding direction. Specifically, as illustrated in FIGS. 3 and 4, the rotating mechanism 160 is connected to the first chuck 151 of the electric wire gripping mechanism 150, and can rotate the first chuck 151 by 180 degrees around a rotation axis P set apart from the first chuck 151 by a predetermined distance. As will be described in detail below, when the rotating mechanism 160 rotates the first chuck 151, which is in the state of gripping the electric wire, by 180 degrees (at this time, the second chuck 152 does not grip the electric wire), the direction of the leading end of the electric wire gripped by the first chuck 151 is changed from the forward feeding direction toward the reverse feeding direction.

The electric wire cutting mechanism 170 is a mechanism that cuts the electric wire guided by the third electric wire guide 130 and fed from the third electric wire guide 130. Specifically, the electric wire cutting mechanism 170 includes a V-shaped lower blade having an opening, which faces upward, and moving upward. The lower blade is disposed between the third electric wire guide 130 and the electric wire gripping mechanism 150. When the electric wire is fed from the third electric wire guide 130, the lower blade is disposed separately from the third electric wire guide 130. For this reason, the electric wire to be fed passes above the lower blade and advances toward the first chuck 151 and the second chuck 152 in the electric wire gripping mechanism 150. On the other hand, when the electric wire fed from the third electric wire guide 130 is cut, the lower blade approaches the third electric wire guide 130. Therefore, when the lower blade is separated from third electric wire guide 130, the electric wire passing above the lower blade is cut by the approach of the lower blade.

The support frame 180 is a frame that is used to fix the first electric wire guide 110, the second electric wire guide 120, the third electric wire guide 130, the electric wire feeding mechanism 140, the electric wire gripping mechanism 150, the rotating mechanism 160, and the electric wire cutting mechanism 170 at predetermined positions.

Although an example of the electric wire cutting device 10 is described with reference to FIGS. 2 to 5, the electric wire processing apparatus, the electric wire processing method, and the electric wire holding structure according to the invention are not limited by the mechanisms of the electric wire cutting device 10.

Figure 6:
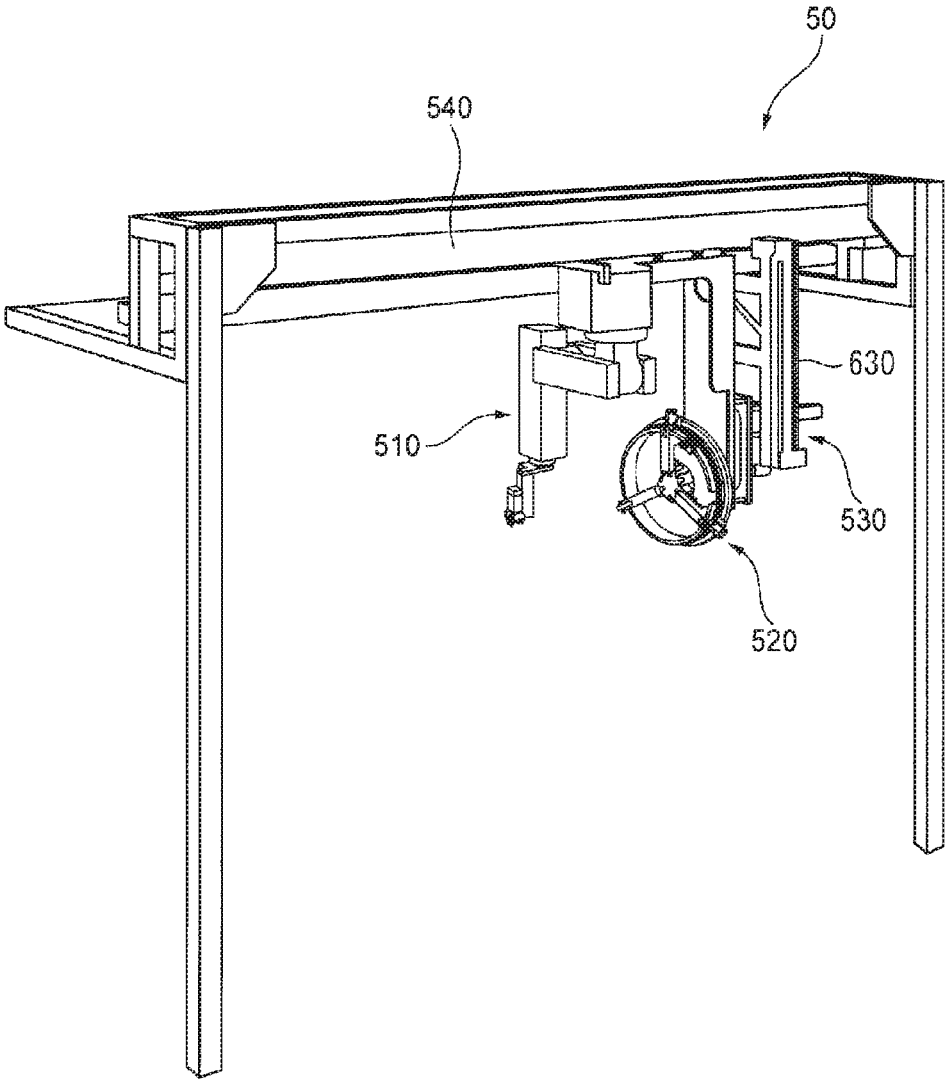
FIG. 6 is a perspective view illustrating an electric wire extracting device according to embodiment of the invention.
Figure 7:
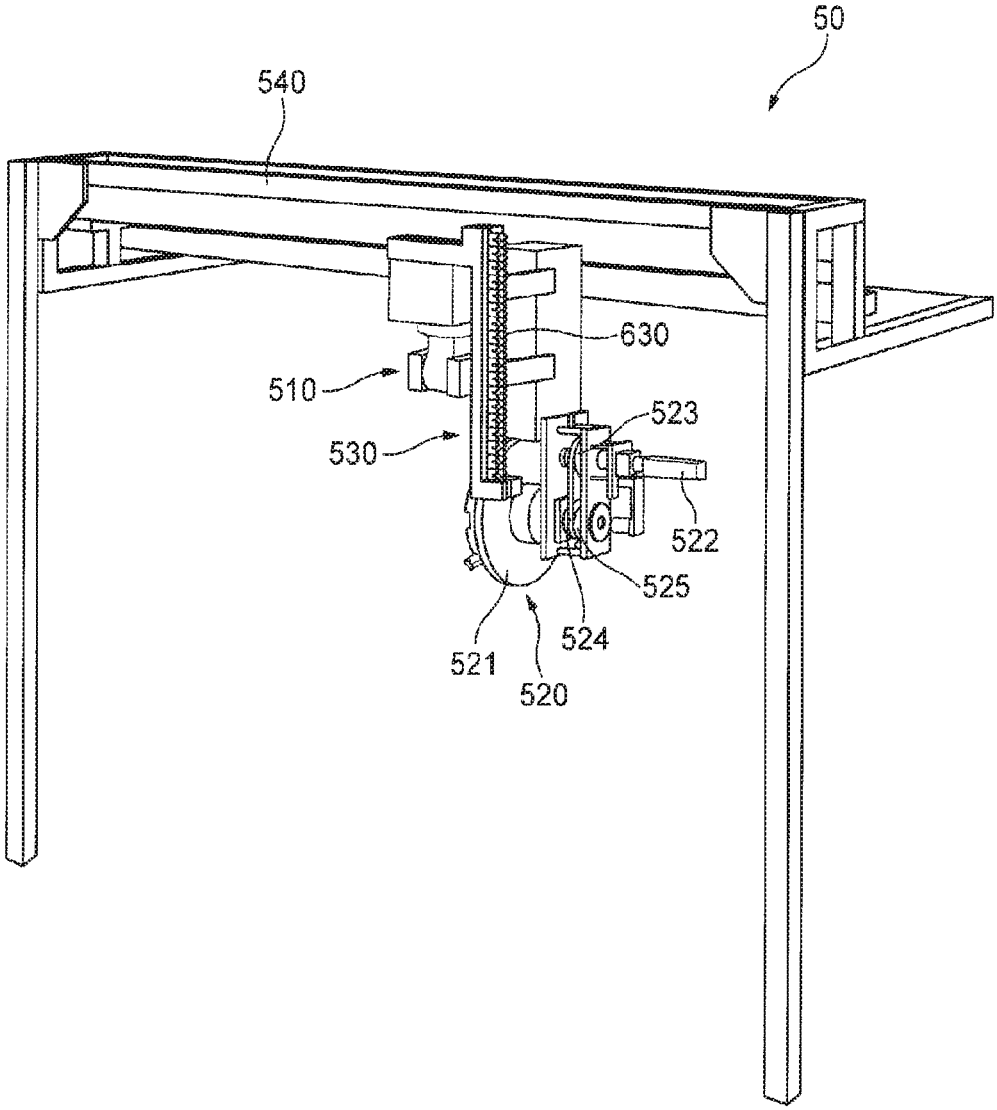
FIG. 7 is a perspective view illustrating of the electric wire extracting device according to embodiment of the invention as viewed from another angle.
Figure 8:
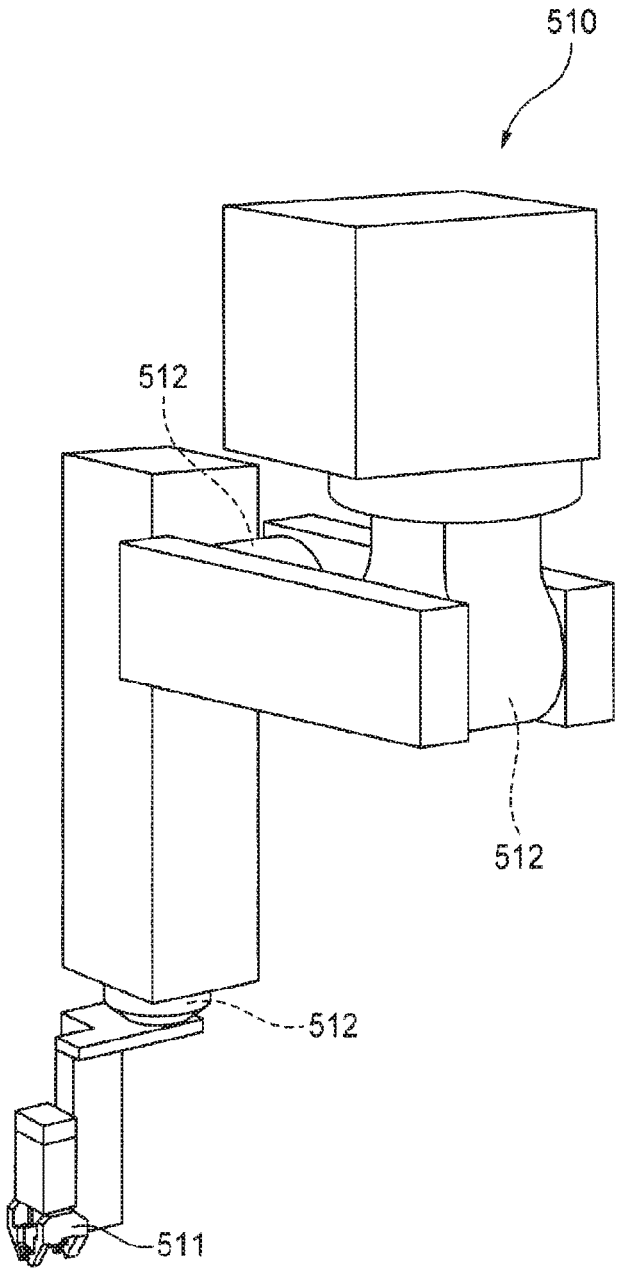
FIG. 8 is a perspective view of a manipulator according to the embodiment of the invention.
Figure 9:
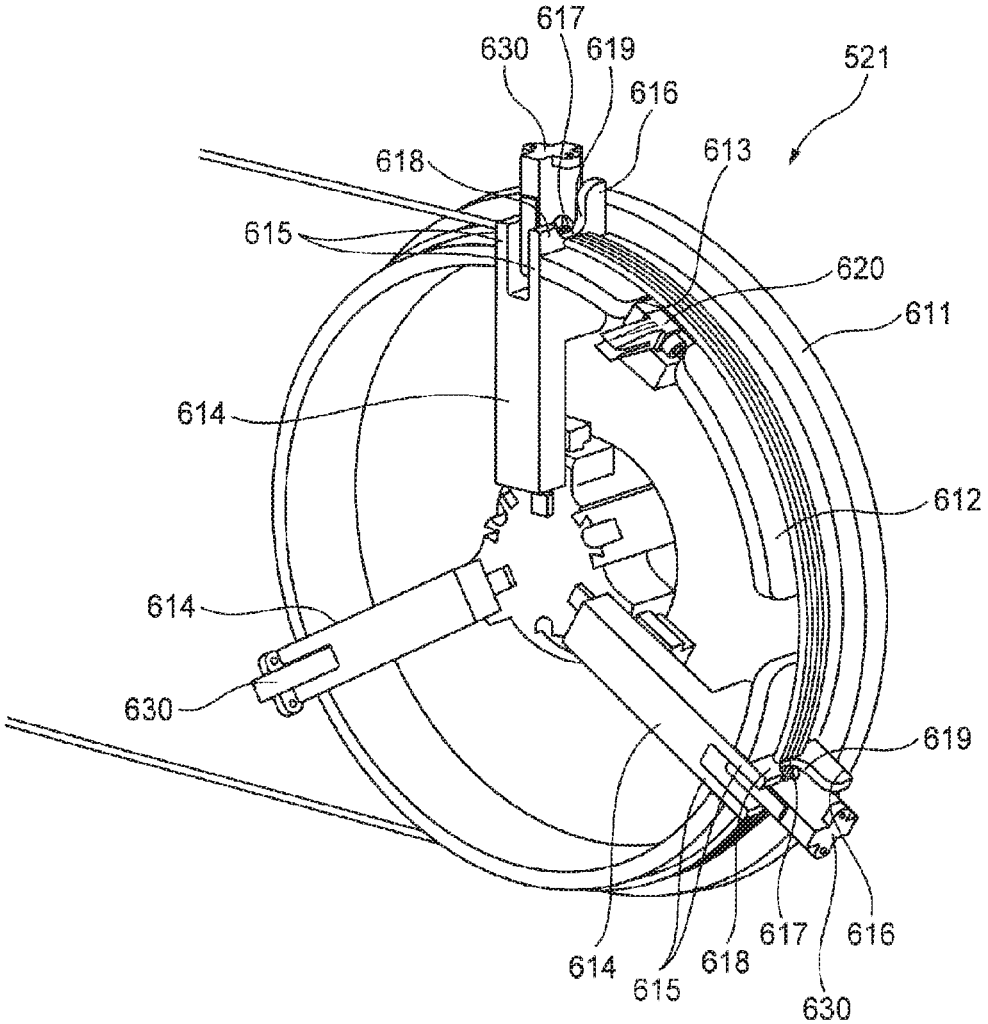
FIG. 9 is a perspective view of an electric wire winding mechanism in which electric wires are wound in the electric wire extracting device according to the embodiment of the invention.
Figure 10:
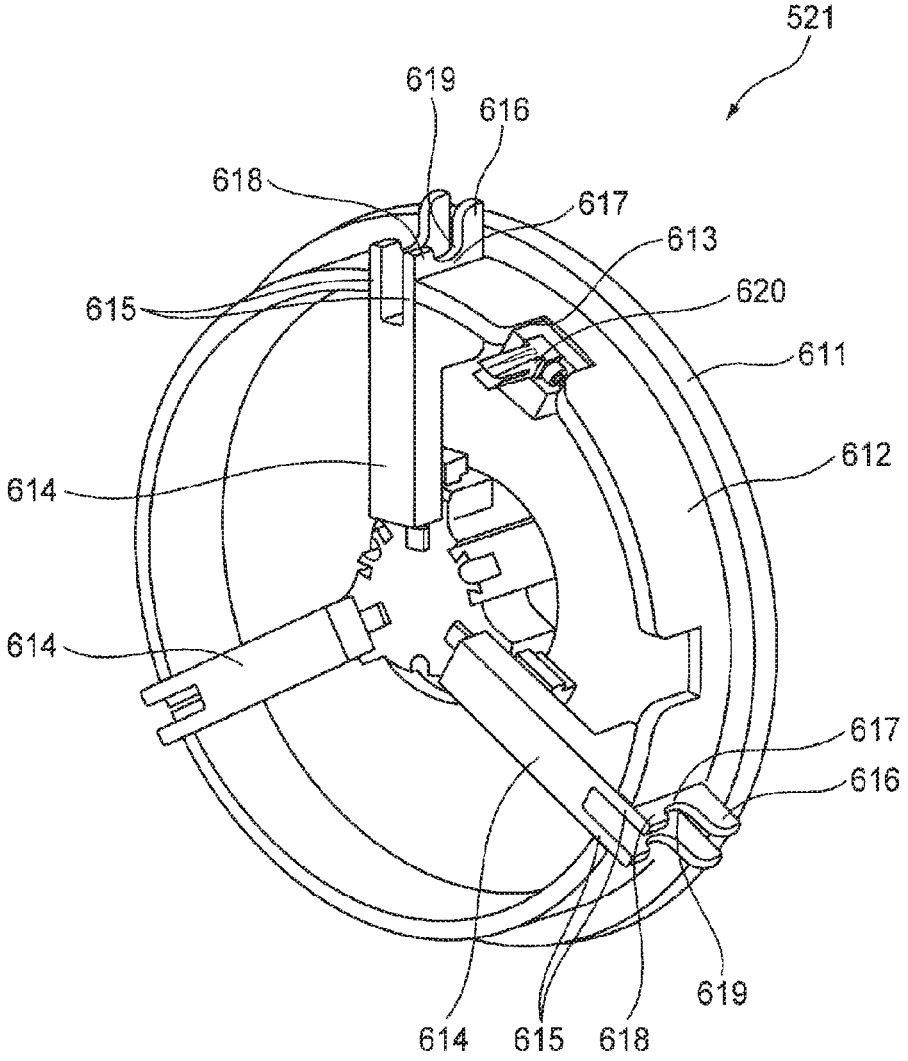
FIG. 10 is a perspective view of the electric wire winding mechanism in which electric wires are not wound in the electric wire extracting device according to the embodiment of the invention.
Figure 11:
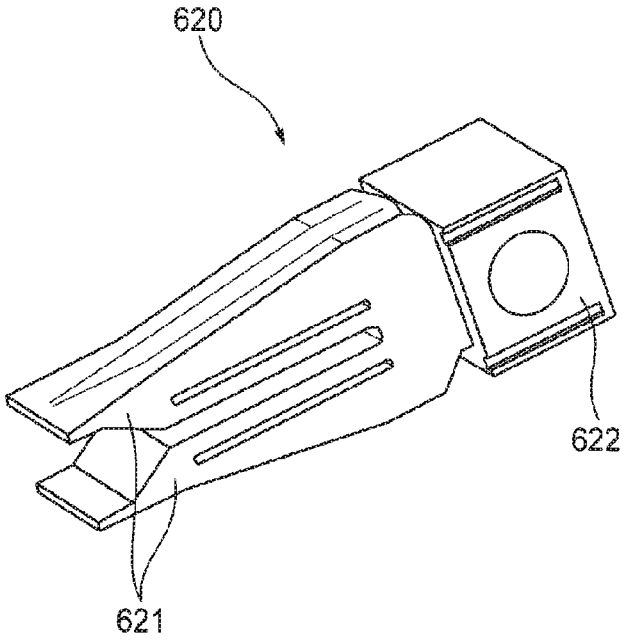
FIG. 11 is a perspective view an electric wire clip in the electric wire winding mechanism according to the embodiment of the invention.
Figure 12:
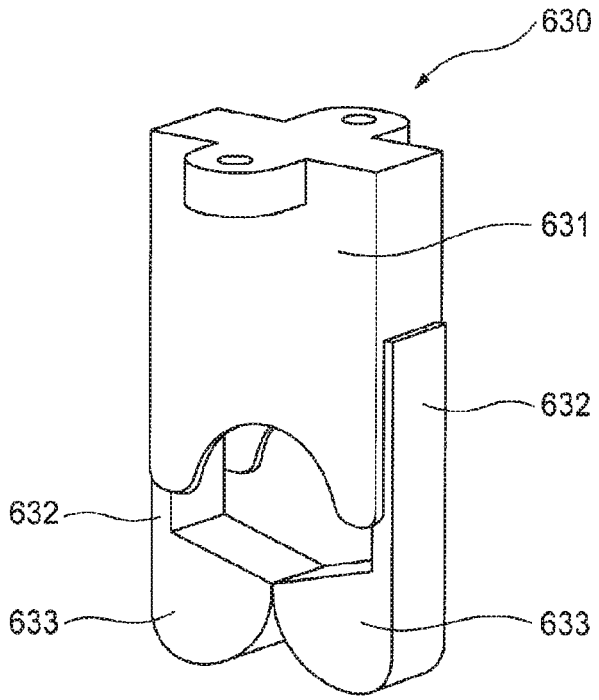
FIG. 12 is a perspective view of a clamp in the electric wire winding mechanism according to the embodiment of the invention.
Figure 13:
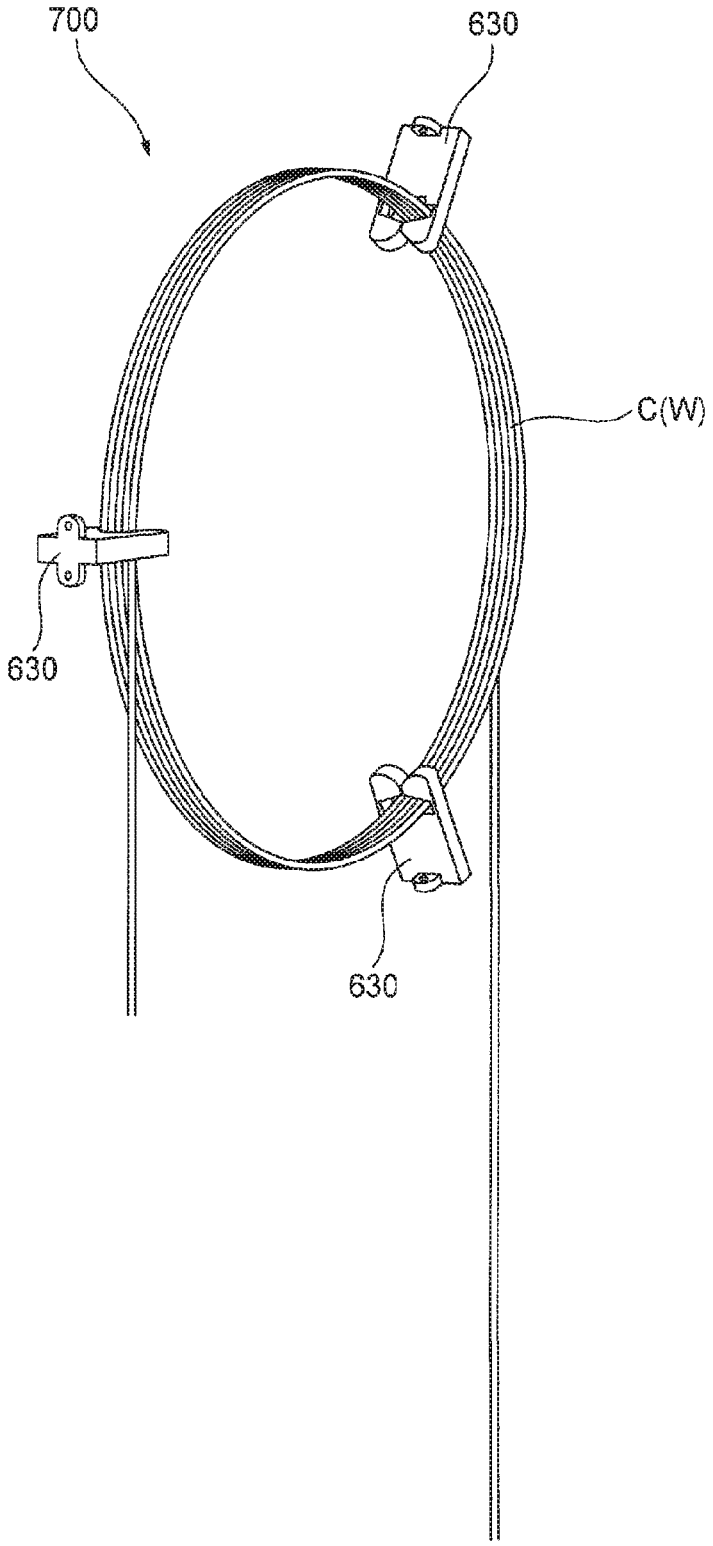
FIG. 13 is a perspective view of an electric wire holding structure according to the embodiment of the invention.

Subsequently, the electric wire extracting device 50 will be described in detail below with reference to FIGS. 6 to 12. FIG. 6 is a perspective view illustrating the electric wire extracting device according to the embodiment of the invention. FIG. 7 is a perspective view of the electric wire extracting device according to the embodiment of the invention as viewed from another angle. FIG. 8 is a perspective view of a manipulator in the electric wire extracting device according to the embodiment of the invention. FIG. 9 is a perspective view of the electric wire winding mechanism, in which the electric wires are wound, in the electric wire extracting device according to the embodiment of the invention. FIG. 10 is a perspective view of a manipulator in the electric wire extracting device according to the embodiment of the invention. FIG. 9 is a perspective view of the electric wire winding mechanism, in which the electric wires are not wound, in the electric wire extracting device according to the embodiment of the invention. FIG. 11 is a perspective view of an electric clip in the electric wire winding mechanism according to the embodiment of the invention. FIG. 12 is a perspective view of a clamp in the electric wire according to the embodiment of the invention. FIG. 13 is a perspective view of an electric wire holding structure according to the embodiment of the invention.

The electric wire extracting device 50 includes a manipulator 510, an electric wire winding mechanism 520, and a clamp storage shelf 530 which are fixed to a support frame 540.

The manipulator 510 is a mechanism that receives the electric wire cut to a predetermined length form the electric wire cutting device 10 and delivers the electric wire to the electric wire winding mechanism 520. Specifically, as illustrated in FIG. 8, the manipulator 510 is a robot arm with three degrees of freedom. A claw-type hand 511 (may be referred to as a gripping mechanist is provided at a tip end of the manipulator 510, while a base frame is attached to the support frame 540. Motors 512 provided in three joints of the manipulator 510 are driven, and thus the hand 511 can move to an arbitrary position with an arbitrary angle in a working space (hereinafter, the motor 512 may be referred to as a driving mechanism). Although will be described in detail below, the manipulator 510 moves the hand 511 to grip the electric wire gripped by the electric wire gripping mechanism 150 of the electric wire cutting device 10 with the hand 511 and to receive the electric wire, and moves the hand 511 in a state of gripping the electric wire to deliver the electric wire to the electric wire winding mechanism 520. Thereafter, the manipulator moves the hand 511 again to the electric wire gripping mechanism 150, and repeatedly performs a series of operations of receiving and delivering with the hand 511.

The electric wire winding mechanism 520 is a mechanism that receives the electric wire supplied from the manipulator 510 and processes a long electric wire to have a shape and a size suitable for conveying to an automatic machine which processes the electric wire. Schematically, as illustrated in FIGS. 6 and 7, the electric wire winding mechanism 520 is a mechanism in which a torque of a motor 522 is transmitted to a disk-shaped winding drum 521 by a pulley 523 and a belt 524 and a rotating shaft 525 rotates, whereby the winding drum 521 rotates. When the winding drum 521 rotates, as illustrated in FIG. 9, the electric wire is wound around the winding drum 521.

A detailed structure of the winding drum 521 will be described with reference to FIGS. 9 and 10. As illustrated in FIG. 10, the winding drum 521 is based on a base frame 611. The base frame 611 has a flat circular shape and is formed with a hole at the center, and the above-described rotating shaft 525 penetrates through the base frame 611. The base frame 611 is provided with a cylindrical winding rib 612 protruding from one surface of the base frame 611 so as to revolve along an edge of the base frame 611. The winding rib 612 has a notch 613 recessed downward in the axial direction from an upper end in the axial direction. An electric wire clip 620, which grips the leading end of the electric wire, is accommodated and attached in the notch 613. The electric wire clip 620 will be described below.

In addition, the winding drum 521 traverses the winding rib 612 by extending outwardly in a radial direction of the base frame 611 from the center of the base frame 611, and has three bar-shaped connection bodies 614 protruding from an outer circumferential surface (a surface being in contact with the electric wire to be wound) of the winding rib 612. The connection body 614 includes an end located at the center of the base frame 611 and connected to the above-described rotating shaft 525 and an end located at an edge of the base frame 611 and connected to the base frame 611. The three connection bodies 614 are disposed at an equal angle (120 degrees) when viewing one surface, on which the winding rib 612 of the base frame 611 is provided, from the front. The base frame 611 is connected to the above-described rotating shaft 525 via the three connection bodies 614, so that the winding drum 521 rotates as the rotating shaft 525 rotates.

Further, the connection body 614 is characterized by the shape of the end located at the edge of the base frame 611. That is, two guide plates 615 extending in a direction orthogonal to the revolving direction of the winding rib 612 are provided at the end of one connection body 614 so as to face each other with a distance therebetween. In addition, one guide plate 615 is configured in which a large protruding piece 616, a small protruding piece 617, and a middle protruding piece 618 are arranged in a protruding direction of the winding rib 612 at a position protruding from an outer circumferential surface (a surface being in contact with the electric wire to be wound) of the winding rib 612. The large protruding piece 616 has the largest protruding length from the outer circumferential surface of the winding rib 612, the middle protruding piece 618 has a second-largest protruding length from the outer circumferential surface of the winding rib 612, and the small protruding piece 617 is the smallest protruding length from the outer circumferential surface of the winding rib 612. For this reason, a recess portion 619 is formed to be sandwiched between both sides of the large protruding piece 616 and the middle protruding piece 618 at the position protruding from outer circumferential surface of the winding rib 612. As illustrated in FIG. 10, the recess portion 619 plays a role of guiding the electric wire wound around the winding rib 612, so that the electric wire wound around the winding rib 612 gathers in the recess portion 619, thereby forming an annular electric wire bundle. In addition, a clamp 630 is accommodated in a space S formed between two guide plates 625 facing each other in the connection body 614. The clamp 630 will be described below.

The electric wire clip 620 is a structure body that receives the electric wire from the manipulator 510 and pinches the leading end of the electric wire. As the electric wire clip 620 holds the leading end of the electric wire, the leading end of the electric wire is attached to the winding drum 521, whereby the electric wire can be wound around the winding rib 612 when the winding drum 521 rotates. As illustrated in FIG. 11, the electric wire clip 620 has a structure in which a pair of pinching elements 621 for pinching the electric wire is fixed to a mounting base 622. The pair of pinching elements 621 are configured in which a pushing direction (height direction) of the article to be pinched into the pinching element 621 extends longer than a pinching direction (width direction) and a thickness direction (depth direction) of the article to be pinched. When the electric wire clip 620 is attached to the winding drum 521, the mounting base 622 is accommodated and fixed into the notch 613 so that the height direction of the pair of pinching elements 621 coincides with the protruding direction of the winding rib 612, and the depth direction thereof coincides with the circumferential direction of the winding rib 612. As a result of the fixation in this way, the pinching direction (width direction) of the article to be pinched between the pair of pinching element 621 coincides with the radial direction of the winding rib 612. The electric wire clip 620 is attached to the notch 613 in this way, and thus, as illustrated in FIG. 9, when the electric wire clip 620 holds the leading end of the electric wire, the leading end of the electric wire can be disposed in a state where the electric wire is wound side by side around the winding rib 612.

The clamp 630 is a holding member that holds the annular electric wire bundle formed in a bundle by the winding of one electric wire. As illustrated in FIG. 12, the clamp 630 includes a box-shaped support frame 631 and a pair of flippers 632 in which one end thereof is rotatably supported on the support frame 631 and the other includes a bulging portion 633 which is bulged. The pair of flippers 632 can take a closed state in which the bulging portions 633 are in contact with each other and an open state in which the bulging portions are separated from each other and are opened. An elastic member such as a spring is connected to the pair of flippers 632, and the bulging portions 633 are maintained in the closed state of being in contact with each other by an elastic force due to the elastic member. When the pair of flippers 632 are in the closed state, a space T surrounded by a lower end of the support frame 631 and an inner side surfaces of the pair of flippers 632 is formed in the clamp 630. As illustrated in FIG. 9, the clamp 630 accommodates the annular electric wire bundle formed in a bundle by the winding of one electric wire and holds the electric wire. When the annular electric wire bundle is accommodated in the space T, the pair of flippers 632 are opened while the electric wire bundle is pressed against the pair of flippers 632 being in the closed state in the vicinity of a contact point where the bulging portions 633 are in contact with each other, and the electric wire bundle slides into the space T as it is. In order to easily accommodate the electric wire bundle in the space T, the pair of flippers 632 have a tapered shape such that the outer side surface of the bulging portion 633 gradually widens as a distance increases from contact point where the bulging portions 633 are in contact with each other.

As illustrated in FIG. 9, three clamps 630 are attached to the annular electric wire bundle wound around the winding rib 612 to hold the electric wire bundle. At this time, each of the clamps 630 is accommodated in the space S formed between two guide plates 615. For this reason, the two guide plates 615 are separated by a distance slightly longer than a thickness of the clamp 630. After the three clamps 630 are respectively inserted into three spaces S to hold the annular electric wire bundle at three points3, the leading end of the electric wire is detached from the electric wire clip 620 and the annular electric wire bundle is removed from the winding rib 612. At this time, the annular electric wire bundle is slid in the protruding direction of the winding rib 612 with respect to the winding rib 612 and removed from the winding rib 612, but the electric wire bundle is slid over the middle protruding piece 618 of the guide plate 615 at that time. Conversely, the middle protruding piece 618 has a height such that the electric wire bundle can get over when the annular electric wire bundle is removed from the winding rib 612. The annular electric wire bundle removed from the winding rib 612 in this way is illustrated in FIG. 13. As illustrated in FIG. 13, the clamps 630 holds three points of the electric wire bundle formed in an annular shape by the winding of one electric wire, and thus the annular electric wire bundle is maintained in a state of the annular shape. A structure including the electric wire and the clamps 630 is referred to as an electric wire holding structure 700 in which three points of the annular electric wire bundle formed in the annular shape by a several winding of one electric wire WT are held by the clamps 630 and the electric wire is maintained in the annular shape. The electric wire winding mechanism 520 is described above.

The clamp storage shelf 530 is a shelf in which the clamp 630 is stored. As illustrated in FIGS. 6 and 7, a plurality of clamps 630 is loaded in a thickness direction in the clamp storage shelf 530.

The support frame 540 is a frame that is used to fix the manipulator 510, the electric wire winding mechanism 520, and the clamp storage shelf 530 at predetermined positions.

Operation of Electric Wire Processing Apparatus

The configuration of the electric wire processing apparatus according to the embodiment of the invention is described in detail above. Hereinafter, an operation of the electric wire processing apparatus according to the embodiment of the invention will be described in detail.

First Example of Operation of Electric Wire Processing Apparatus

Figure 14A:
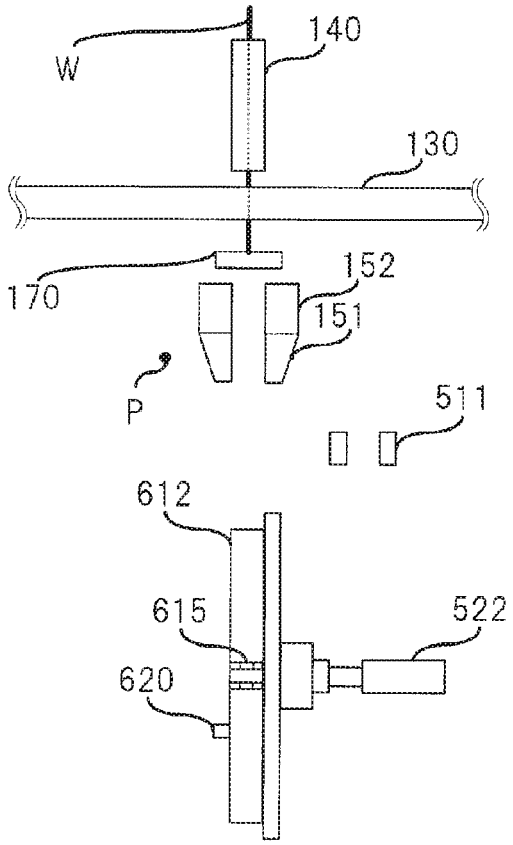
FIGS. 14A and 14B are diagrams schematically depicting an example of an operation of the electric wire processing apparatus according to the embodiment of the invention.
Figure 14B:
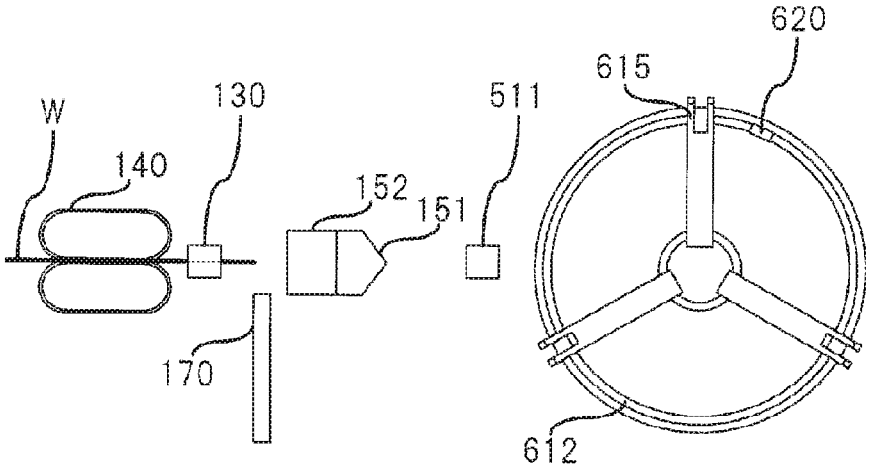

FIGS. 14A and 14B to FIGS. 30A and 30B are diagrams schematically depicting an example of an operation of the electric wire processing apparatus according to the embodiment of the invention. "A" in the drawings is a plan view schematically illustrating a main part relating to the operation of the electric wire processing apparatus 1 when the electric wire processing apparatus 1 is seen from the top. "B" in the drawings is a side view schematically illustrating the main part relating to the operation of the electric wire processing apparatus 1 when the electric wire processing apparatus 1 is seen from the side. FIGS. 14A and 14B to FIGS. 30A and 30B illustrate a series of processes in which the electric wire processing apparatus 1 processes one electric wire W, and each of the drawings depicts one operation in this series of processes. After this series of processes is performed by the electric wire processing apparatus 1, as illustrated in FIGS. 14A, 14B, and 30A, the electric wire holding structure 700 including the electric wire W and the clamp 630 is completed in which three points of an annular electric wire bundle C formed in an annular shape by a several winding of one electric wire W are held by the clamps 630 and the electric wire is maintained in the annular shape. The operation of the electric wire processing apparatus 1 will be described below.

After the previous series of processes is completed by the electric wire processing apparatus 1, as illustrated in FIGS. 14A and 14B, the leading end of the electric wire W cut by the electric wire cutting mechanism 170 of the electric wire cutting device 10 in the previous series of processes is in a state of staying on the electric wire cutting mechanism 170. Further, the winding rib 612 of the electric wire winding mechanism 520 in the electric wire extracting device 50 is disposed in front of the electric wire feeding mechanism 140 of the electric wire cutting device 10, whereby the winding rib 612 is located on a straight line through which the electric wire feeding mechanism 140 feeds the electric wire W.

Figure 15A:
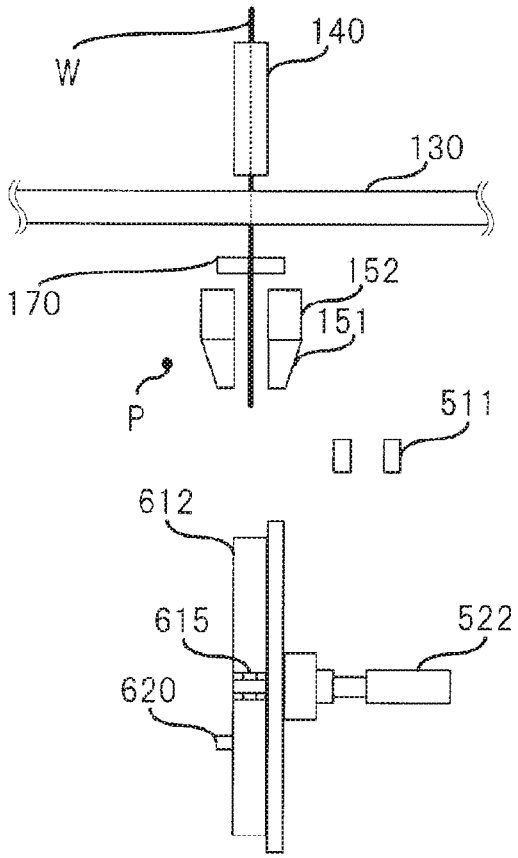
FIGS. 15A and 15B are diagrams schematically depicting an example of an operation of the electric wire processing apparatus according to the embodiment of the invention.
Figure 15B:
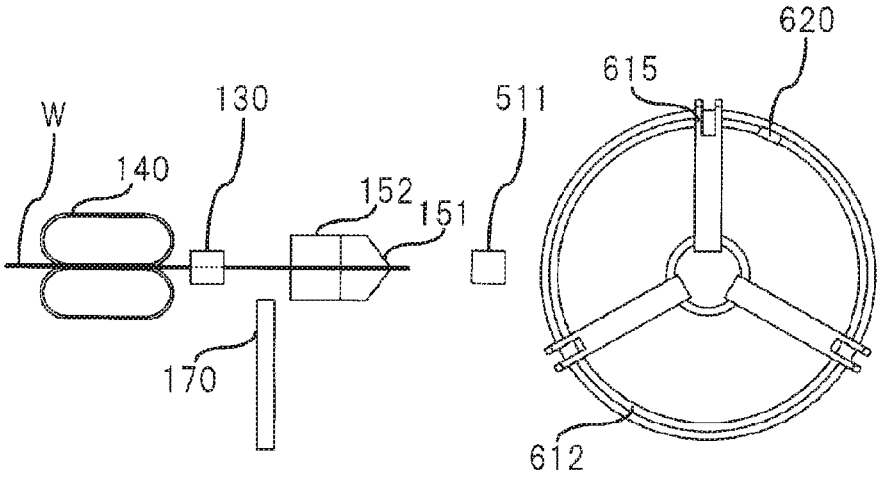

First, as illustrated in FIGS. 15A and 15B, the electric wire feeding mechanism 140 feeds the electric wire W to the extent that the leading end of the electric wire W passes through the first chuck 151 and the second chuck 152 of the electric wire gripping mechanism 150. The number of rotations of the pulley 143 and the pulley 146 is counted when the electric wire W is fed, whereby a length L1 of the electric wire W fed by the operation illustrated in FIGS. 15A and 15B is measured.

Figure 16A:
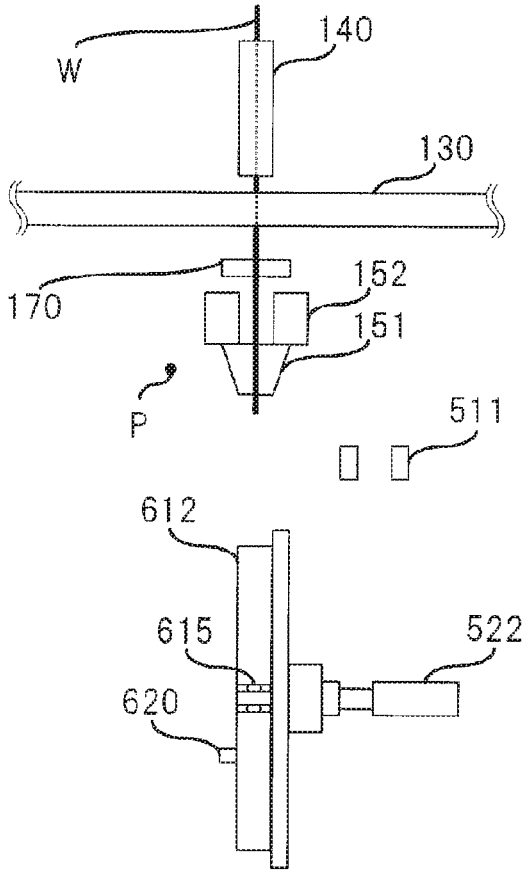
FIGS. 16A and 16B are diagrams schematically depicting an example of an operation of the electric wire processing apparatus according to the embodiment of the invention.
Figure 16B:
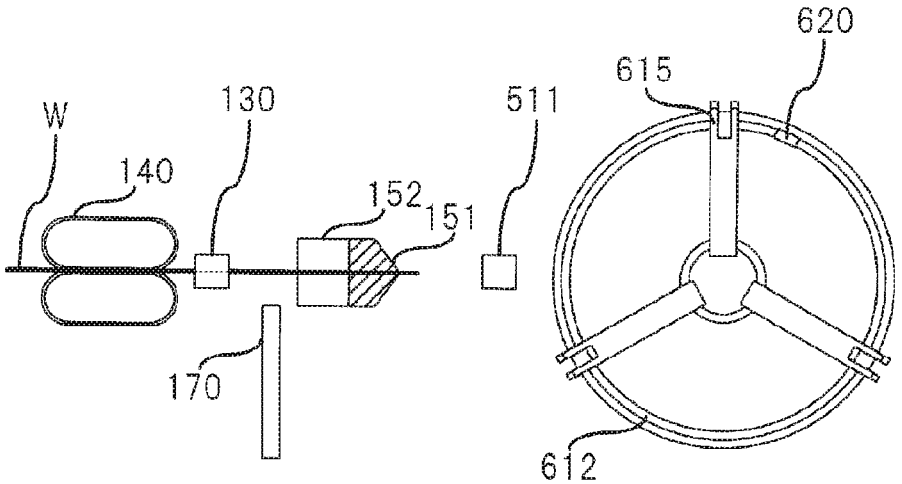

Subsequently, as illustrated in FIGS. 16A and 16B, the first chuck 151 of the electric wire gripping mechanism 150 is closed to grip the electric wire W. In FIG. 16B, the closed state of the first chuck 151 is represented by hatching in the range indicating the first chuck 151.

Figure 17A:
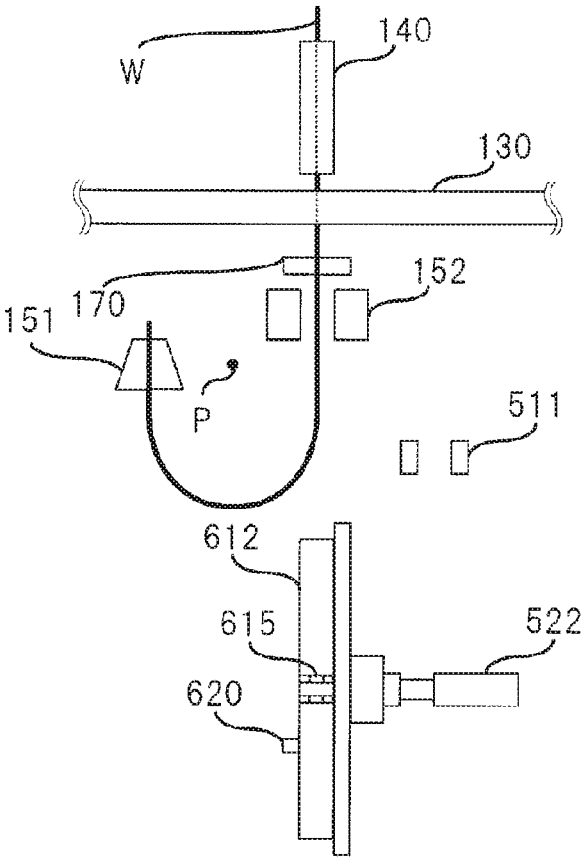
FIGS. 17A and 17B are diagrams schematically depicting an example of an operation of the electric wire processing apparatus according to the embodiment of the invention.
Figure 17B:
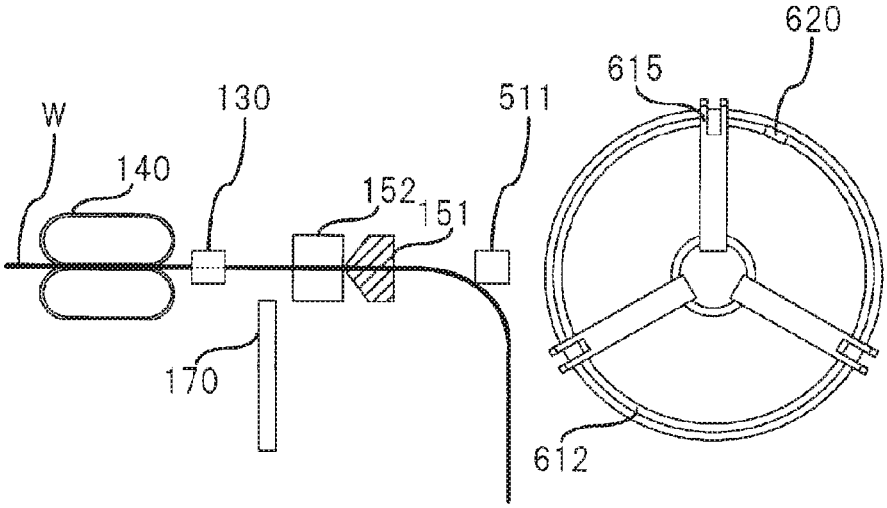

Subsequently, as illustrated in FIGS. 17A and 179, the rotating mechanism 160 rotates the first chuck 151 by 180 degrees in a clockwise direction around the rotation axis P. As the first chuck 151 rotates, the electric wire feeding mechanism 140 feeds the electric wire W. Additionally, a length L2 of the electric wire W fed by the operation illustrated in FIGS. 17A and 179 is also measured. At this time, the length L2 of the electric wire W fed by the electric wire feeding mechanism 140 is shorter than a total extension of the annular electric wire W illustrated in FIGS. 13 and 30A, and preferably has a length to the extent that the electric wire W suspended by its own weight floats in the air without being in contact with the installation surface of the electric wire processing apparatus 1 as illustrated in FIG. 17B. When the rotating mechanism 160 rotates the first chuck 151, which is in the state of gripping the electric wire, by 180 degrees, the direction of the leading end of the electric wire gripped by the first chuck 151 is changed to the reverse feeding direction from the forward feeding direction. In this way, the electric wire W is fed after the first chuck 151 is reversed, and thus the first chuck 151 is moved to a position where feeding of the electric wire W with the electric wire feeding mechanism 140 is not disturbed. Further, when the direction of the leading end of the electric wire W is reversed, it is not necessary for the hand 511 to reverse the leading end of the electric wire W when the hand 511 inserts the leading end of the electric wire W into the electric wire clip 620 in the operation to be described below with reference to FIGS. 21A and 21B, and the movement of the hand 511 can be suppressed.

Figure 18A:
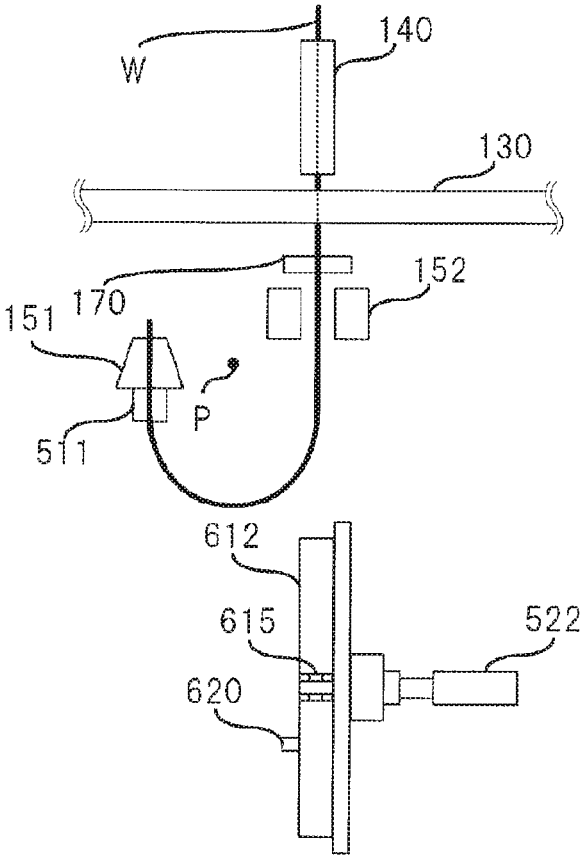
FIGS. 18A and 18B are diagrams schematically depicting an example of an operation of the electric wire processing apparatus according to the embodiment of the invention.
Figure 18B:
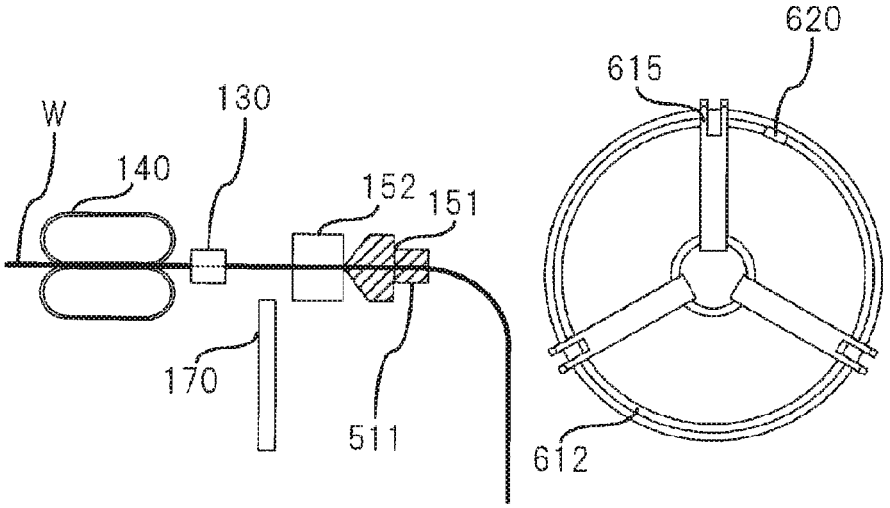

Subsequently, as illustrated in FIGS. 18A and 18B, the manipulator 510 moves the hand 511 adjacently to the electric wire winding mechanism 520 of the first chuck 151, and the hand 511 grips the electric wire gripped by the first chuck 151. In FIG. 18B, the closed state of the hand 511 is represented by hatching in the range indicating the hand 511.

Figure 19A:
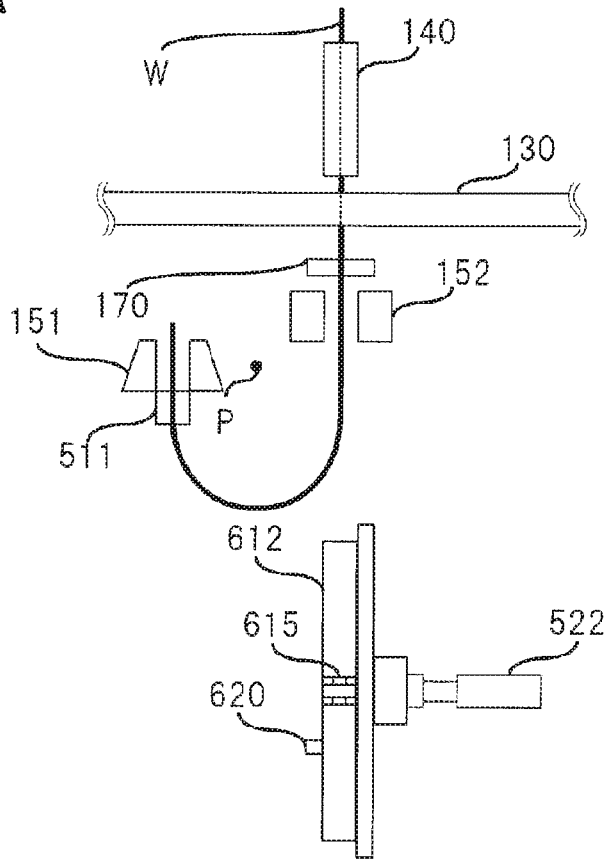
FIGS. 19A and 19B are diagrams schematically depicting an example of an operation of the electric wire processing apparatus according to the embodiment of the invention.
Figure 19B:
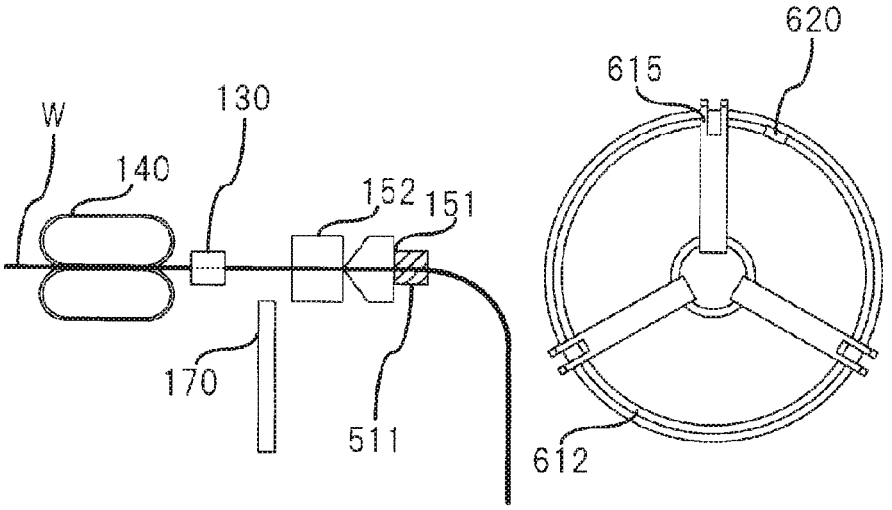

Subsequently, as illustrated in FIGS. 19A and 19B, the first chuck 151 of the electric wire gripping mechanism 150 is opened to release the gripped electric wire W.

Figure 20A:
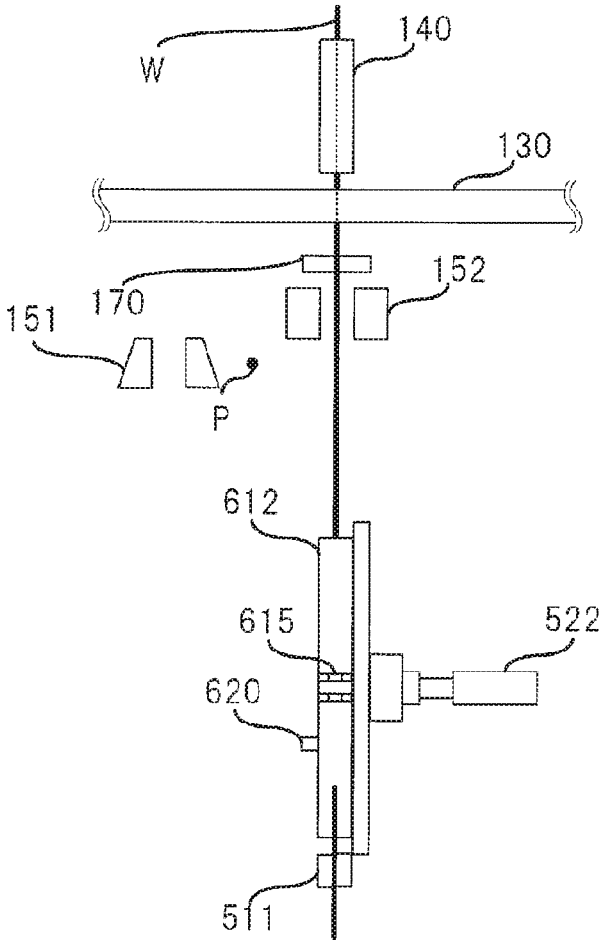
FIGS. 20A and 20B are diagrams schematically depicting an example of an operation of the electric wire processing apparatus according to the embodiment of the invention.
Figure 20B:
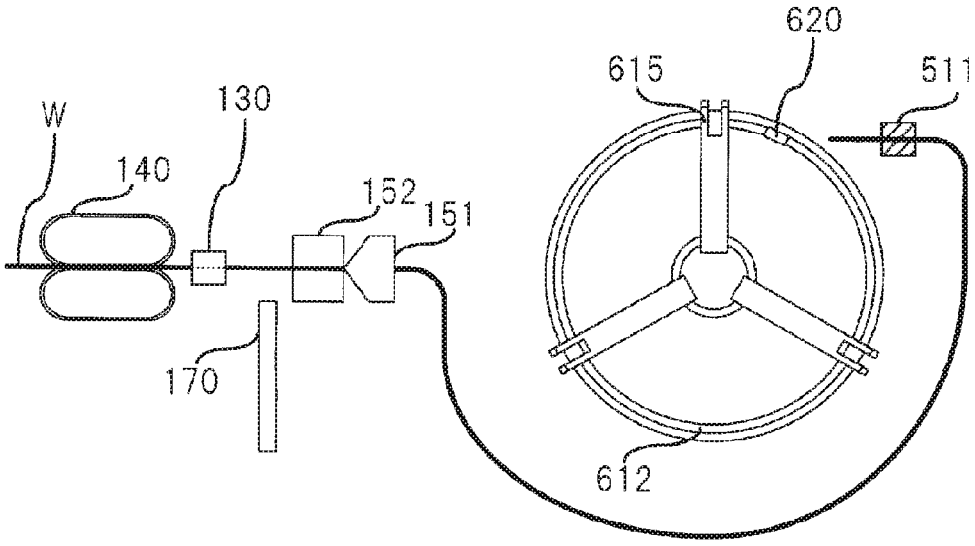

Subsequently, as illustrated in FIGS. 20A and 20B, the manipulator 510 moves the hand 511 to a position adjacent to the winding rib 612 and opposite to the side where the electric wire cutting device 10 is located. At this time, the hand 511 is located on the straight line through which the electric wire W is fed by the electric wire feeding mechanism 140 when the electric wire processing apparatus 1 is viewed from the top as illustrated in FIG. 20A, and is located at substantially the same height as the height at which the electric wire clip 620 is located when the electric wire processing apparatus 1 is viewed from the side as illustrated in FIG. 20B. Further, as the hand 511 moves, the electric wire feeding mechanism 140 feeds the electric wire W. Additionally, a length L3 of the electric wire W fed by the operation illustrated in FIGS. 20A and 20B is also measured. By the operation of the hand 511 and the electric wire feeding mechanism 140, the electric wire W from the electric wire feeding mechanism 140 to the hand 511 is located on the straight line through which the electric wire W is fed by the electric wire feeding mechanism 140 when the electric wire processing apparatus 1 is viewed from the top as illustrated in FIG. 20A, and the electric wire W extending from the hand 511 descends toward the lower side (a downward side in FIG. 20B) of the winding rib 612 so as to bypass the winding rib 612 when the electric wire processing apparatus 1 is viewed from the side as illustrated in FIG. 20B and ascends toward the electric wire feeding mechanism 140 from the moment of passing a position just below the winding rib 612. With such a positional relation of the electric wire W, the electric wire W wound around the winding rib 612 can be easily collected in the recess portion 619 of the guide plate 615 when the electric wire W is wound around the winding rib 612 by the subsequent operation.

Figure 21A:
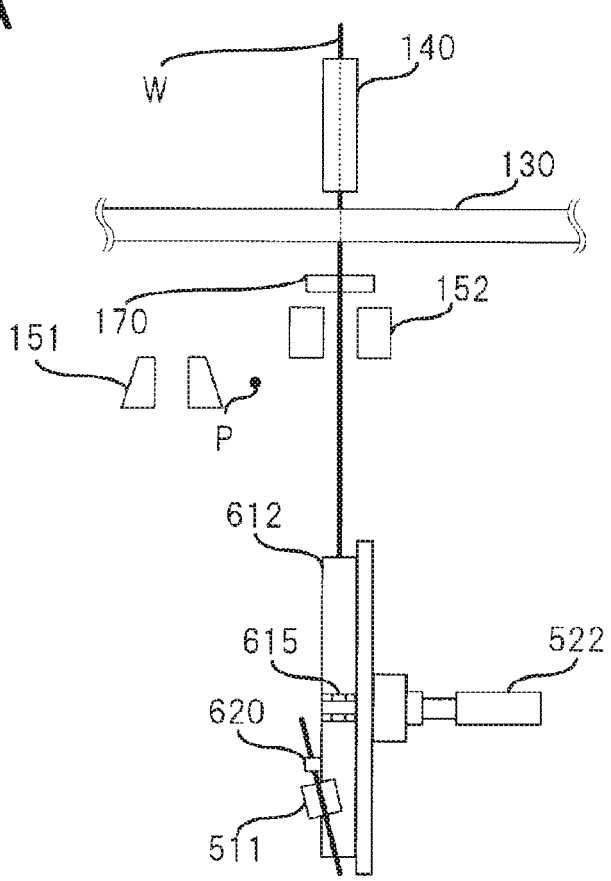
FIGS. 21A and 21B are diagrams schematically depicting an example of an operation of the electric wire processing apparatus according to the embodiment of the invention.
Figure 21B:
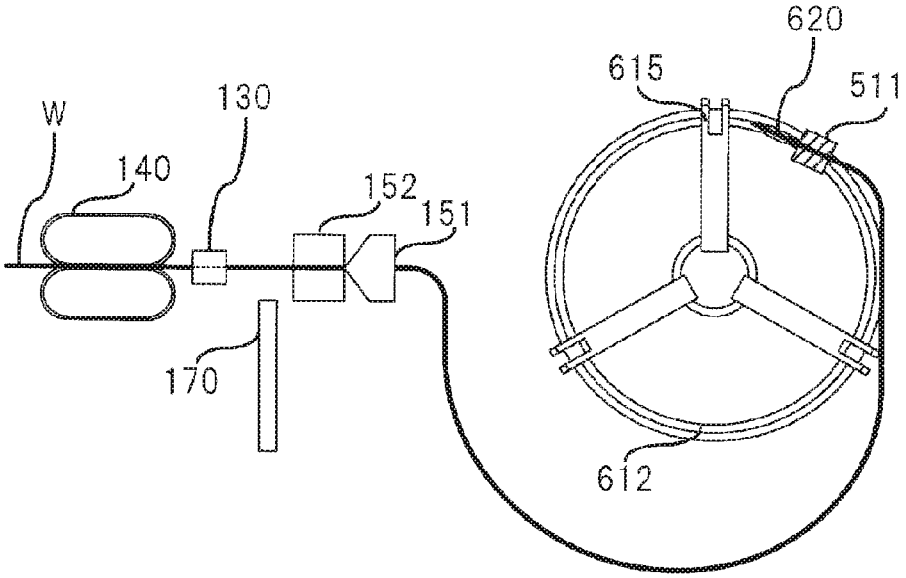

Subsequently, as illustrated in FIGS. 21A and 21B, the manipulator 510 moves the hand 511 adjacently to the electric wire clip 620 provided on the winding drum 521, and thus the leading end of the electric wire W gripped by the hand 511 is pushed between the pair of pinching elements 621 of the electric wire clip 620. At this time, as illustrated in FIG. 21A, the hand 511 is rotated in a yaw direction, and thus a part of the leading end of the electric wire W partially protrudes to the side opposite to the base frame 611 of the winding rib 612. In this way, the hand 511 is moved toward the electric wire clip 620 in a state where the hand 511 is moved in the yaw direction and thus the leading end of the electric wire W is inclined with respect to a plane orthogonal to the axial direction of the winding rib 612, whereby it is possible to maintain a stale where a portion other than the leading end of the electric wire W is located on the straight line through which the electric wire W is fed by the electric wire feeding mechanism 140 when the electric wire processing apparatus 1 is viewed from the top as illustrated in FIG. 21A. That is, the position of the electric wire is prevented from being shifted every time the electric wire is wound around the winding drum 521. Further, as illustrated in FIG. 21B, the hand 511 is rotated in a pitch direction so that the depth direction of the electric wire clip 620 corresponding to the position of the electric wire clip 620 coincides with the direction in which the leading end of the electric wire W extends (in other words, the pinching direction of the article to be pinched between the pair of pinching elements 621 of the electric wire clip 620 is orthogonal to the direction where the leading end of the electric wire W extends). In this way, the hand 511 is moved toward the electric wire clip 620 in the state where the hand 511 is rotated in the pitch direction and thus the pinching direction between the pair of pinching elements 621 is orthogonal to the direction where the leading end of the electric wire W extends, so that the leading end of the electric wire W can be easily pushed between the pinching elements 621 of the electric wire clip 620. When the leading end of the electric wire W is pushed between the pinching elements 621 of the electric wire clip 620, the manipulator 510 moves the hand 511 once to the left side from the electric wire clip 620 in FIG. 21A, and then the leading end of the electric wire W is pushed between the pinching elements 621 of the electric wire clip 620 using the momentum that the hand 511 moves to the right side toward the electric wire clip 620. When the hand 511 comes in to contact with the winding rib 612 in the case where the hand 511 moves toward the electric wire clip 620, since the contact place between the hand 511 and the winding rib 612 is determined according to the position of the electric wire clip 620, a notch is provided at a predetermined contact place to cope with the contact between the hand 511 and the winding rib 612. A jig may be formed on the hand 511 to spread out the pinching element 621 of the electric wire clip 620, and the leading end of the electric wire W may be accommodated inside the pinching element 621 which is spread out.

Figure 22A:
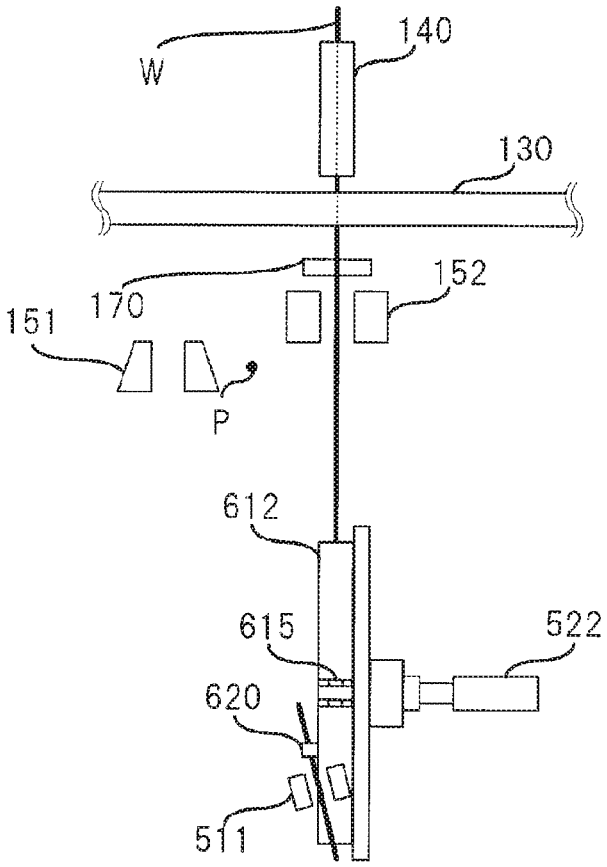
FIGS. 22A and 22B are diagrams schematically depicting an example of an operation of the electric wire processing apparatus according to the embodiment of the invention.
Figure 22B:
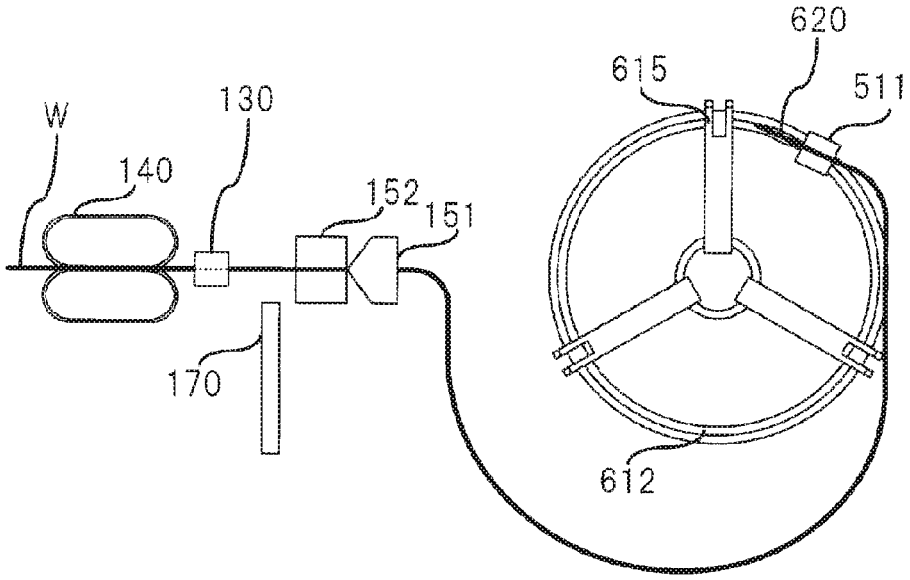

Subsequently, as illustrated in FIGS. 22A and 22B, the manipulator 510 opens the hand 511 to release the electric wire W which is gripped.

Figure 23A:
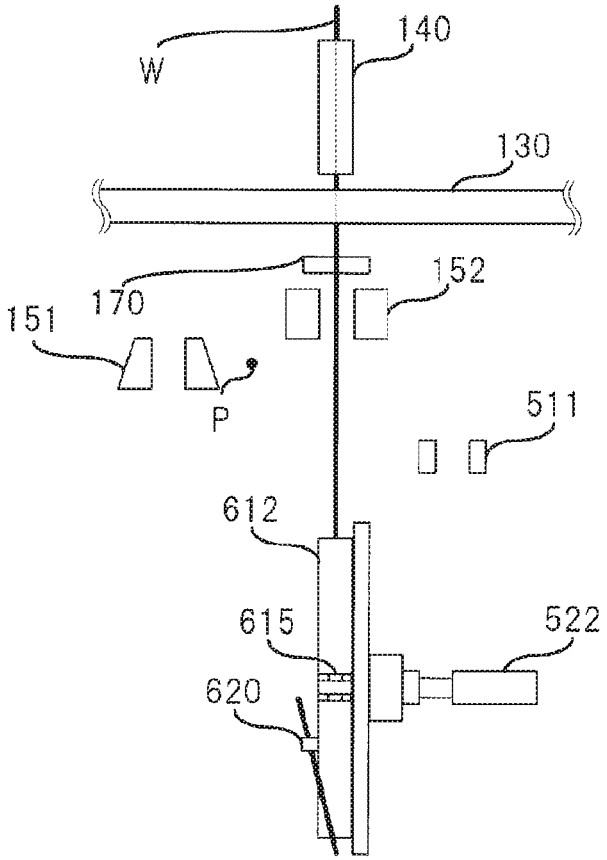
FIGS. 23A and 23B are diagrams schematically depicting an example of an operation of the electric wire processing apparatus according to the embodiment of the invention.
Figure 23B:
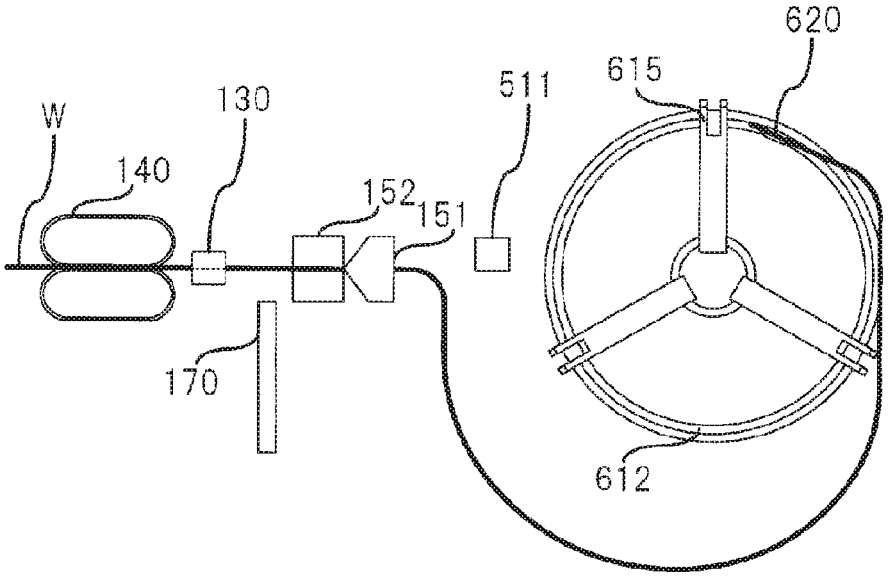

Subsequently, as illustrated in FIGS. 23A and 23B, the manipulator 510 moves the hand 511 to an initial position.

Figure 24A:
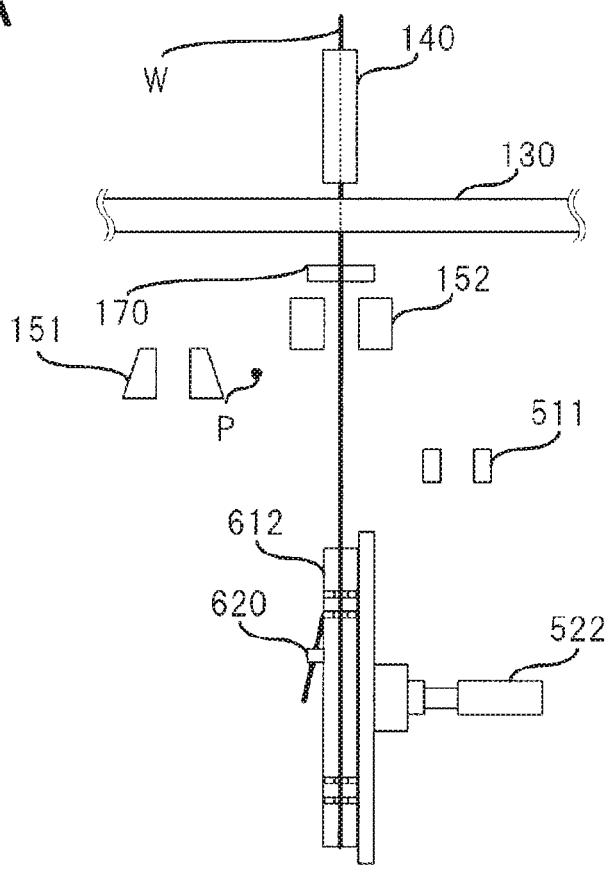
FIGS. 24A and 24B are diagrams schematically depicting an example of an operation of the electric wire processing apparatus according to the embodiment of the invention.
Figure 24B:
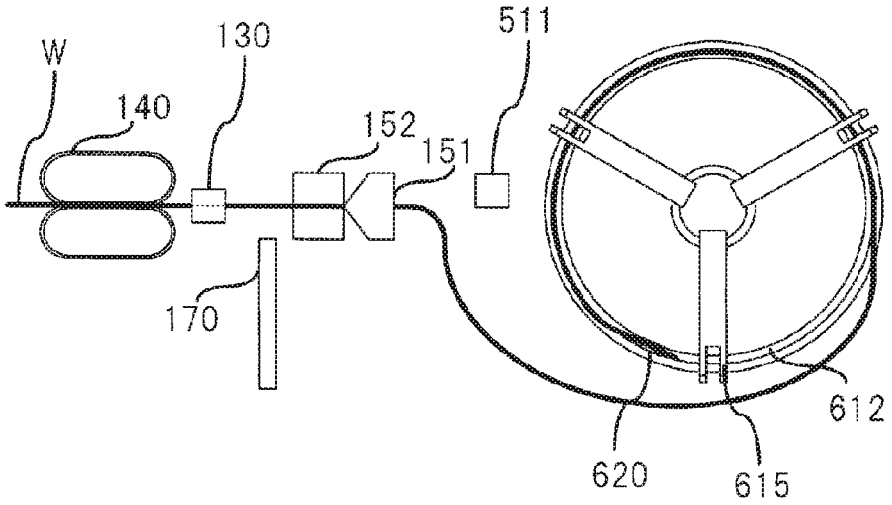
Figure 25A:
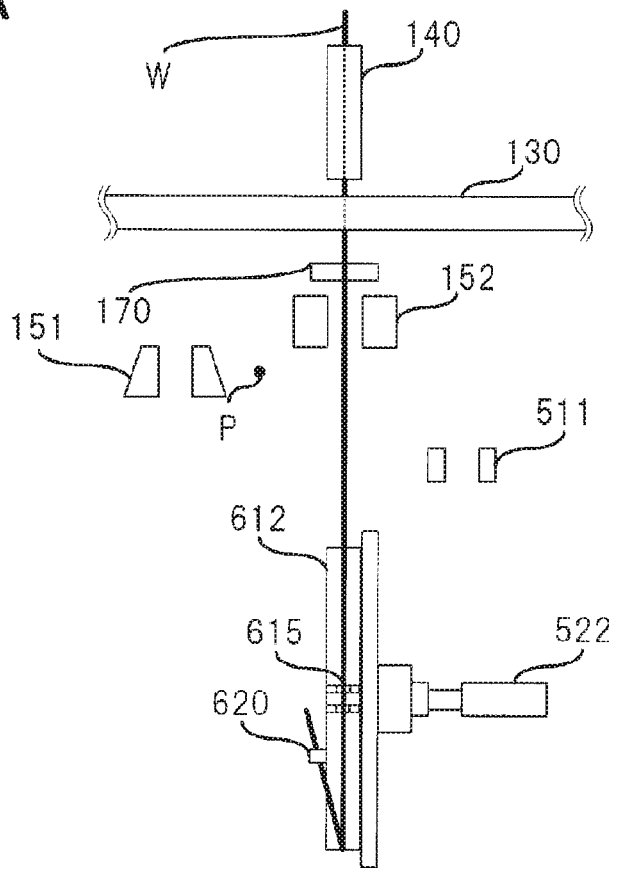
FIGS. 25A and 25B are diagrams schematically depicting an example of an operation of the electric wire processing apparatus according to the embodiment of the invention.
Figure 25B:
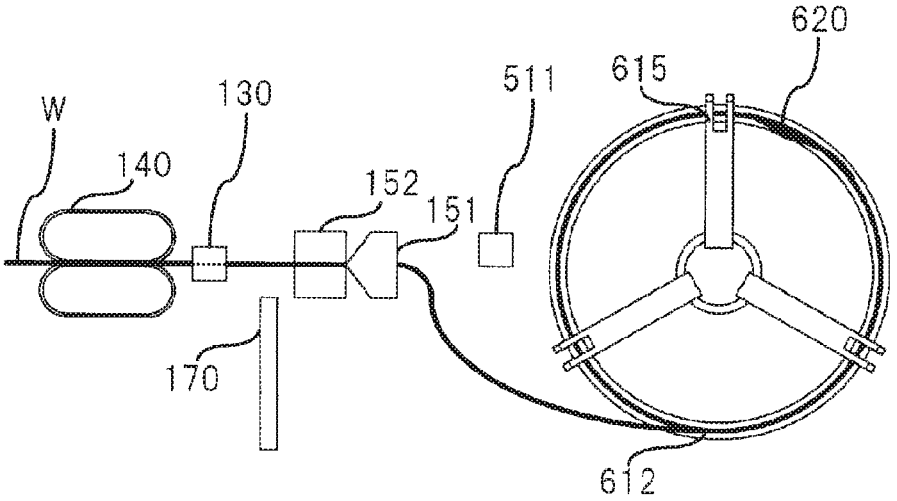

Subsequently, as illustrated in FIGS. 24A and 24B, the electric wire winding mechanism 520 drives the motor 522 to rotate the winding drum 521. The winding drum 521 rotates counterclockwise in FIG. 24B. During the operation illustrated in FIGS. 24A and 24B, the electric wire feeding mechanism 140 does not feed the electric wire W, so that the electric wire W slackened under the winding rib 612 is wound around the winding rib 612 by the rotation of the winding drum 521. In this way, as illustrated in FIGS. 25A and 25B, the electric wire feeding mechanism 140 does not feed the electric wire W until the electric wire W comes in contact with the lower end of the winding rib 612, and the electric wire W is wound around the winding rib 612.

Figure 26A:
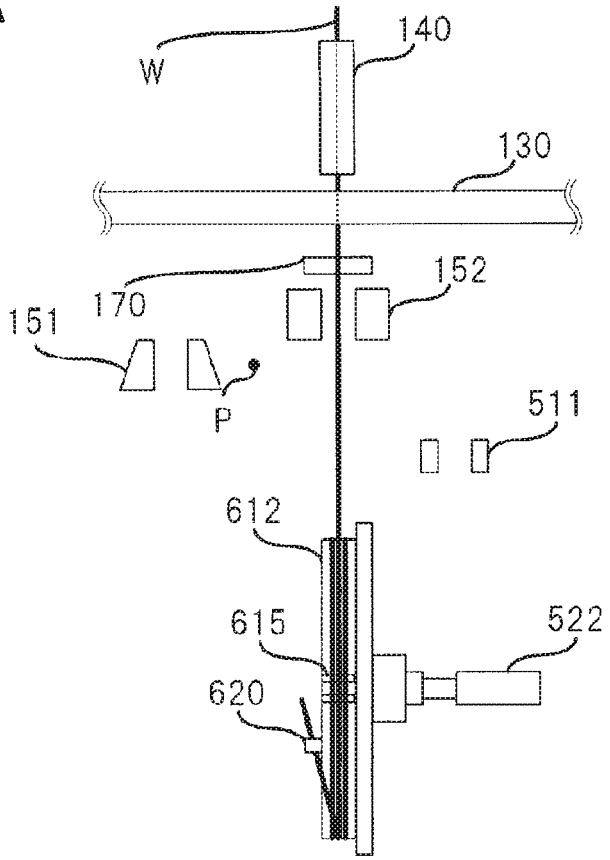
FIGS. 26A and 26B are diagrams schematically depicting an example of an operation of the electric wire processing apparatus according to the embodiment of the invention.
Figure 26B:
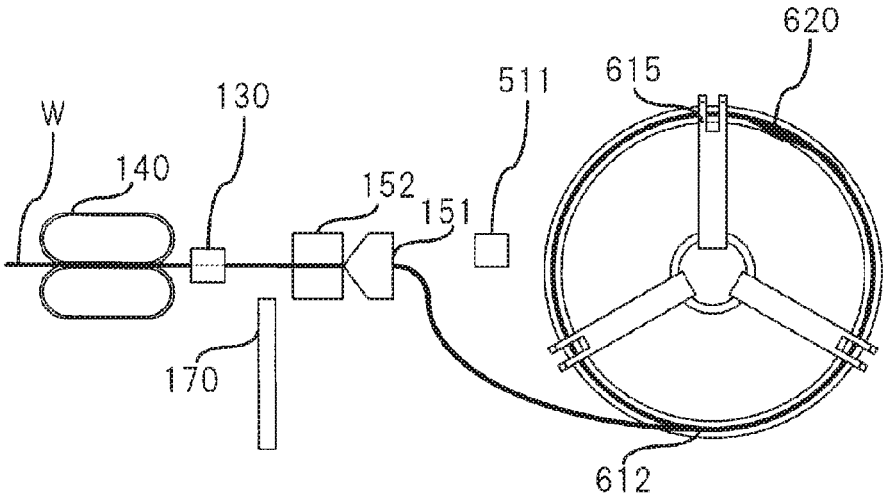

Subsequently, as illustrated in FIGS. 26A and 26B, the electric wire winding mechanism 520 drives the motor 522 to rotate the winding drum 521. During the operation illustrated in FIGS. 26A and 269, the electric wire feeding mechanism 140 feeds the electric wire W. A length L4 of the electric wire W fed by the operation illustrated in FIGS. 26A and 26B is also additionally measured. At this time, the electric wire feeding mechanism 140 controls the amount of electric wire W to be fed and the electric wire winding mechanism 520 controls the number of rotations of the winding drum 521 such that the length of the electric wire W fed by the electric wire feeding mechanism 140 per time is equal to the length of the electric wire W wound around the outer circumferential surface of the winding rib 612 per time. FIGS. 26A and 26B illustrate a state in which the winding drum 521 rotates several times and the electric wire W is wound around the winding rib 612 several times. Thereafter, when the total value of the lengths (L1, L2, L3, and L4) of the electric wire fed in four operations reaches a predetermined length, the electric wire feeding mechanism 140 stops the feeding of the electric wire W, and the electric wire winding mechanism 520 stops the rotation of the winding drum 521.

Figure 27A:
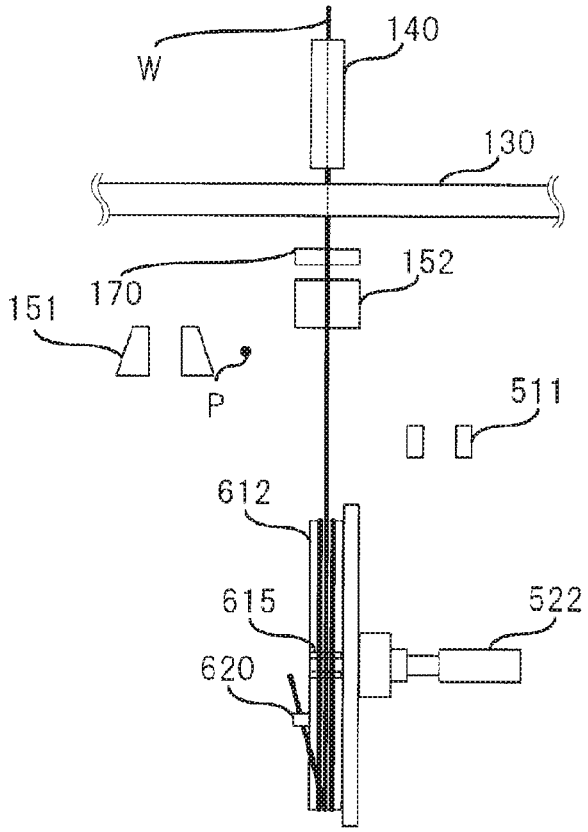
FIGS. 27A and 27B are diagrams schematically depicting an example of an operation of the electric wire processing apparatus according to the embodiment of the invention.
Figure 27B:
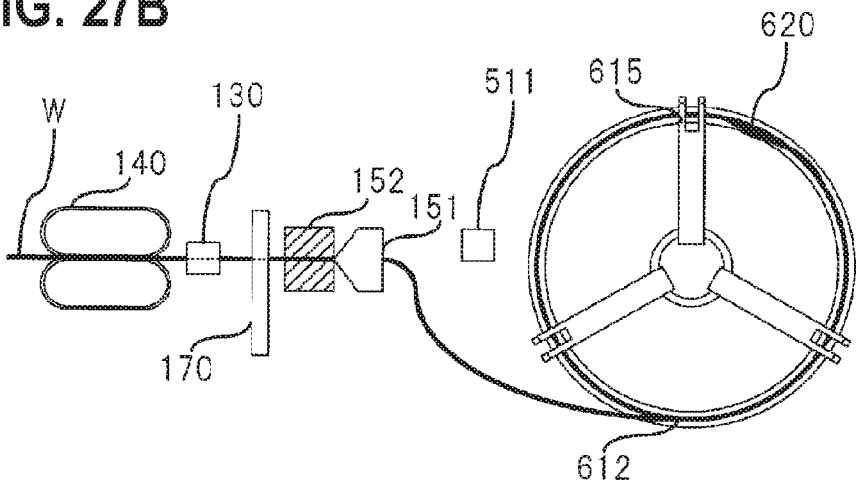

Subsequently, as illustrated in FIGS. 27A and 27B, the second chuck 152 of electric wire gripping mechanism 150 is closed to grip the electric wire W. Subsequently, the lower blade of the electric wire cutting mechanism 170 approaches the third electric wire guide 130 to cut the electric wire W.

Figure 28A:
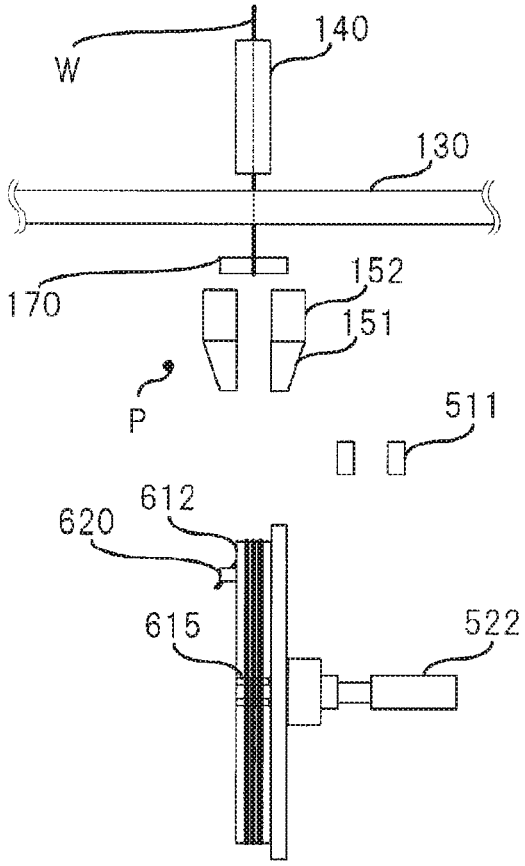
FIGS. 28A and 28B are diagrams schematically depicting an example of an operation of the electric wire processing apparatus according to the embodiment of the invention.
Figure 28B:
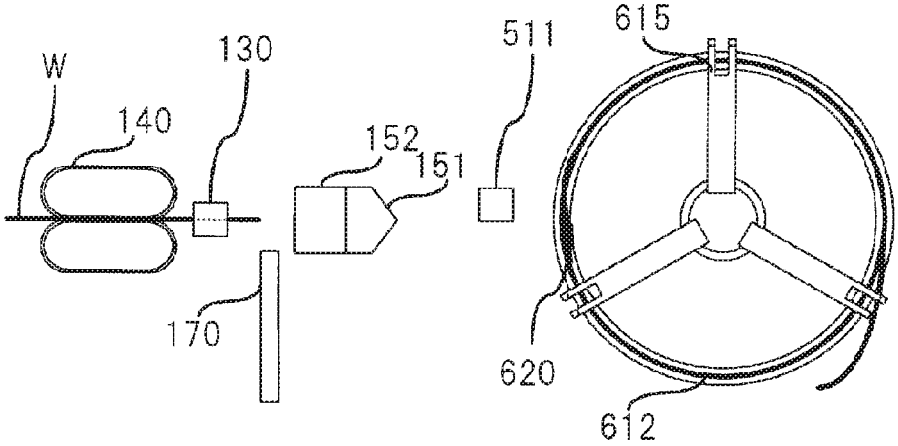

Subsequently, as illustrated in FIGS. 28A and 28B, the second chuck 152 of the electric wire gripping mechanism 150 is opened to release the gripped electric wire W. Subsequently, the electric wire winding mechanism 520 drives the motor 522 to rotate the winding drum 521. Next, the rotating mechanism 160 rotates the first chuck 151 by 180 degrees in a counterclockwise direction around the rotation axis P. During the operation illustrated in FIGS. 28A and 289, the electric wire feeding mechanism 140 does not feed the electric wire W. The other end of the electric wire W gripped by the second chuck 152 of the electric wire gripping mechanism 150 in FIGS. 27A and 27B is wound around the winding rib 612 by the rotation of the winding drum 521. Thus, as illustrated in FIGS. 28A and 28B, the total extension length of the electric wire W cut into a predetermined length is wound around the winding rib 612.

Figure 29A:
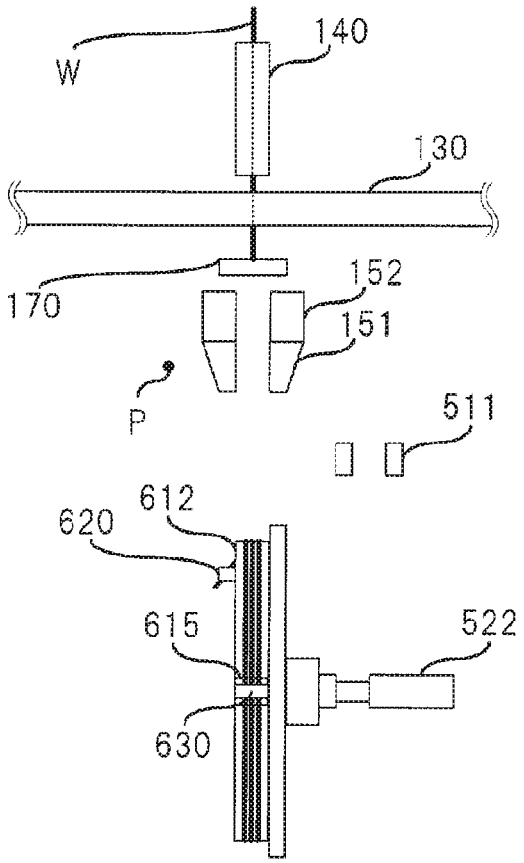
FIGS. 29A and 29B are diagrams schematically depicting an example of an operation of the electric wire processing apparatus according to the embodiment of the invention.
Figure 29B:
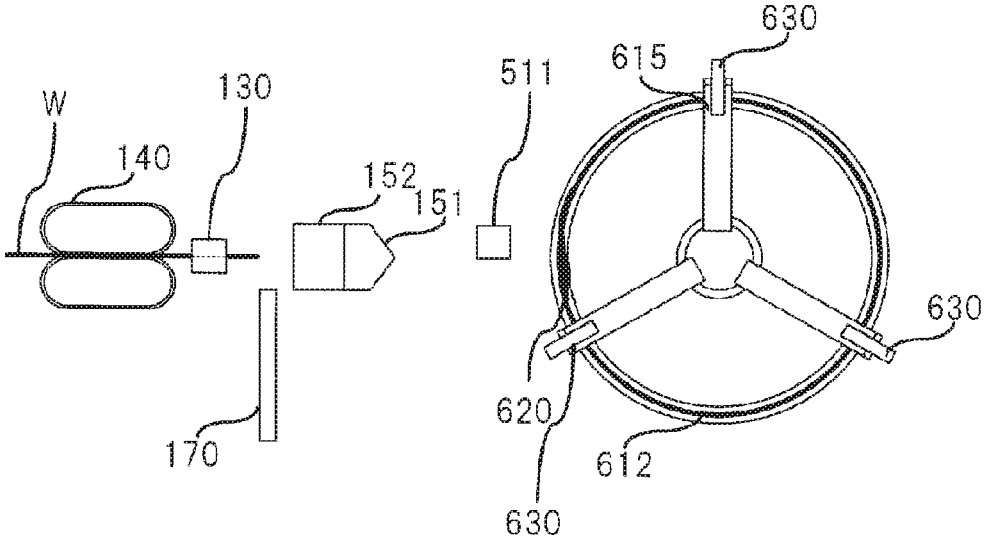
Figure 30A:
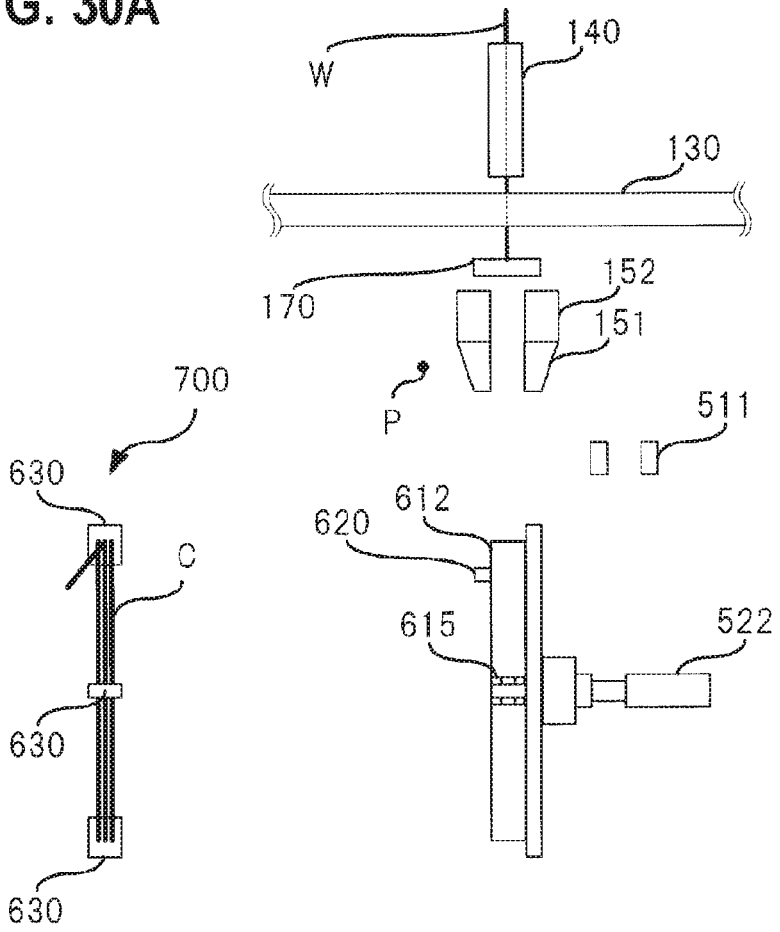
FIGS. 30A and 30B are diagrams schematically depicting an example of an operation of the electric wire processing apparatus according to the embodiment of the invention.

Subsequently, as illustrated in FIGS. 29A and 29B, three clamps 630 are attached to the annular electric wire bundle C wound around the winding rib 612. At this time, the clamp 630 is accommodated in the space S formed between the guide plates 615.

Figure 30B:
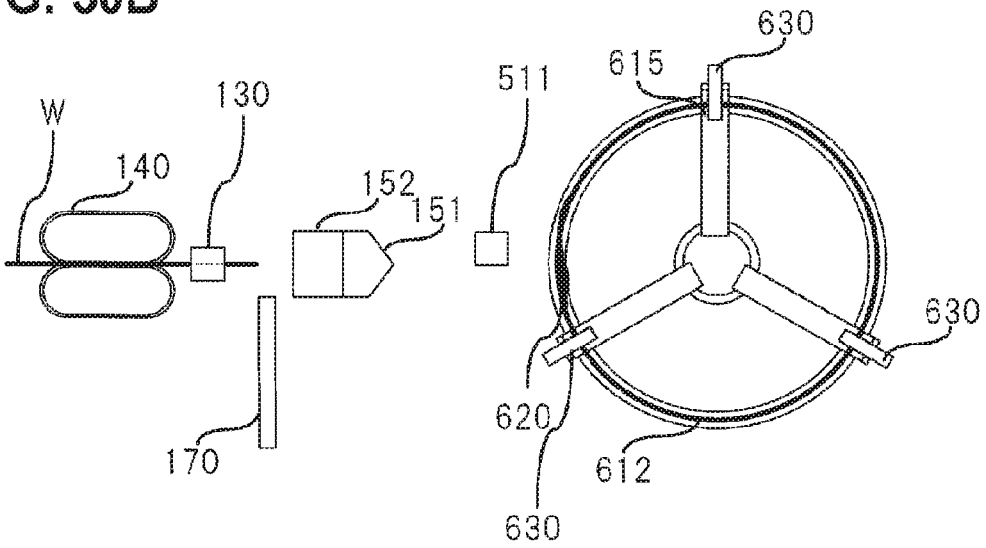

Subsequently, as illustrated in FIGS. 30A and 30B, the leading end of the electric wire is detached from the electric wire clip 620 and the annular electric wire bundle C is removed from the winding rib 612. At this time, the annular electric wire bundle C is slid in the protruding direction of the winding rib 612 with respect to the winding rib 612 and removed from the winding rib 612. As illustrated in FIGS. 13 and 30A, the clamps 630 holds three points of the electric wire bundle C formed in an annular shape by the winding of one electric wire, and thus the annular electric wire bundle C is maintained in a state of the annular shape.

As described above with reference to FIGS. 14A to 30B, the electric wire processing apparatus according to the embodiment of the invention processes one electric wire W into the electric wire holding structure 700. According to the electric wire holding structure 700, even in the case of manufacturing a wire harness using a long electric wire longer than a normal length, there is no need for the worker to deform the electric wire to have a shape and a size suitable for conveying the long electric wire to an automatic machine which processes the electric wire. Further, since the shape of the electric wire holding structure 700 is maintained in the annular shape, the electric wire holding structure 700 may be conveyed to the automatic machine for processing the electric wire by being hung on a hook, and thus the conveyance of the electric wire holding structure 700 is also easily automated. Thus, according to the electric wire processing apparatus and the electric wire processing method of the embodiment of the invention, and the electric wire holding structure used in the electric wire processing apparatus and the electric wire processing method, it is possible to obtain an excellent effect of contributing to improvement in productivity when the long electric wire is conveyed to the automatic machine for processing the electric wire.

The clamp 630 is used to maintain the annular shape of the electric wire bundle C in the example described above, but the invention is not limited to the case where the annular electric wire bundle C is held by the clamp 630. For example, instead of the clamp 630, a tape may be wound around the electric wire bundle C to maintain the shape of the electric wire bundle C in an annular shape. Briefly, various members can be applied to maintain the shape of the electric wire bundle C in an annular shape.

Further, three clamps 630 are used to maintain the annular shape of the electric wire bundle C in the example described above, but the invention is not limited to the case where the electric wire bundle C is held at three places. Even when the electric wire bundle C is held at one place, the electric wire bundle C can be maintained in an annular shape. On the other hand, when the electric wire bundle C is held at a plurality of places, the electric wire bundle C can be maintained in an annular shape more similar to a circular shape.

Second Example of Operation of Electric Wire Processing Apparatus

In the "first example of the operation of the electric wire processing apparatus" described above, as FIGS. 20A and 20B, the case is described in which the manipulator 510 moves the hand 511 to the side opposite to the side on which the electric wire cutting device 10 is located with respect to the winding drum 521, and then the electric wire extracting device 50 processes the electric wire W. In a "second example of the operation of the electric wire processing apparatus", a case will be described in which the manipulator 510 moves the hand 511 to the same side as the side on which the electric wire cutting device 10 is located with respect to the winding drum 521, and then the electric wire extracting device 50 processes the electric wire W.

FIGS. 31A and 31B to FIGS. 43A and 43B are diagrams schematically depicting an example of an operation of the electric wire processing apparatus according to the embodiment of the invention. "A" in the drawings is a plan view schematically illustrating a main part relating to the operation of the electric wire processing apparatus 1 when the electric wire processing apparatus 1 is seen from the top. "B" in the drawings is a side view schematically illustrating the main part relating to the operation of the electric wire processing apparatus 1 when the electric wire processing apparatus 1 is seen from the side. FIGS. 31A and 31B to FIGS. 43A and 43B illustrate a series of processes in which the electric wire processing apparatus 1 processes one electric wire W, and each of the drawings depicts one operation in this series of processes. After this series of processes is performed by the electric wire processing apparatus 1, as illustrated in FIGS. 14A and 14B, the electric wire holding structure 700 including the electric wire W and the clamp 630 is completed in which three points of an annular electric wire bundle C formed in an annular shape by a several winding of one electric wire W are held by the clamps 630 and the electric wire is maintained in the annular shape. The operation of the electric wire processing apparatus 1 will be described below.

Figure 31A:
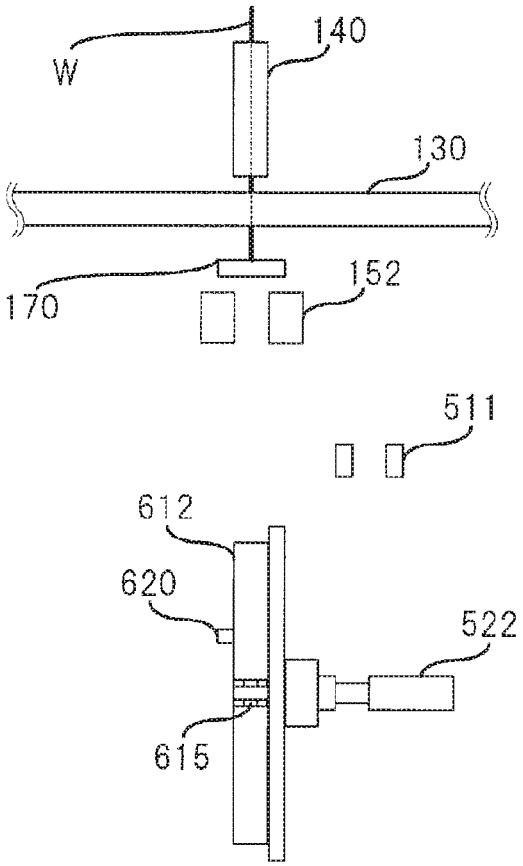
FIGS. 31A and 31B are diagrams schematically depicting an example of an operation of the electric wire processing apparatus according to the embodiment of the invention.
Figure 31B:
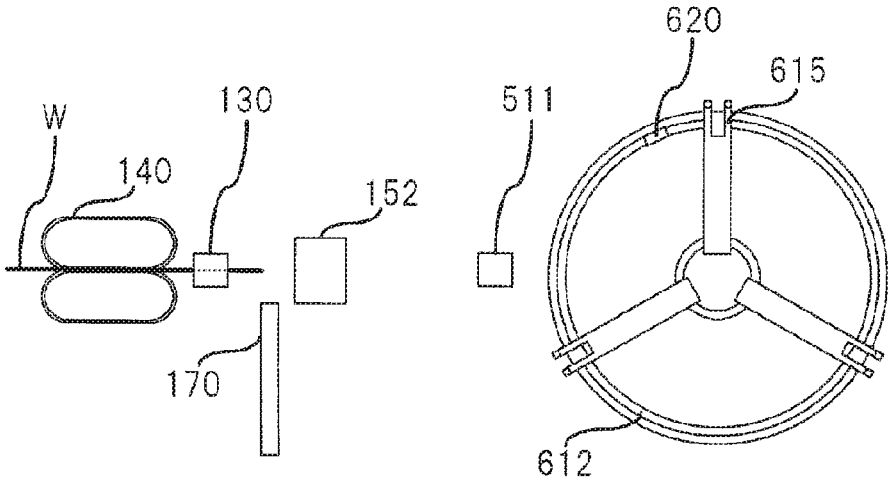

After the previous series of processes is completed by the electric wire processing apparatus 1, as illustrated in FIGS. 31A and 31B, the leading end of the electric wire W cut by the electric wire cutting mechanism 170 of the electric wire cutting device 10 in the previous series of processes is in a state of staying on the electric wire cutting mechanism 170. Further, the winding rib 612 of the electric wire winding mechanism 520 in the electric wire extracting device 50 is disposed in front of the electric wire feeding mechanism 140 of the electric wire cutting device 10, whereby the winding rib 612 is located on a straight line through which the electric wire feeding mechanism 140 feeds the electric wire W.

Figure 32A:
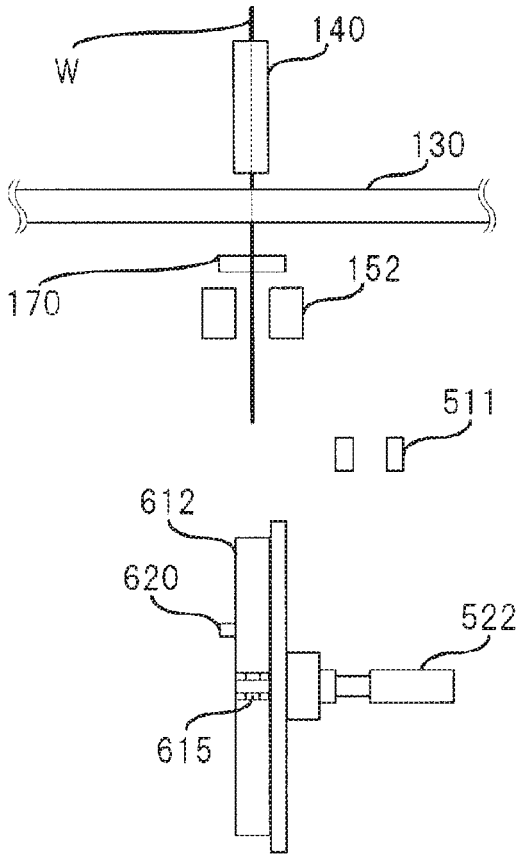
FIGS. 32A and 32B are diagrams schematically depicting an example of an operation of the electric wire processing apparatus according to the embodiment of the invention.
Figure 32B:
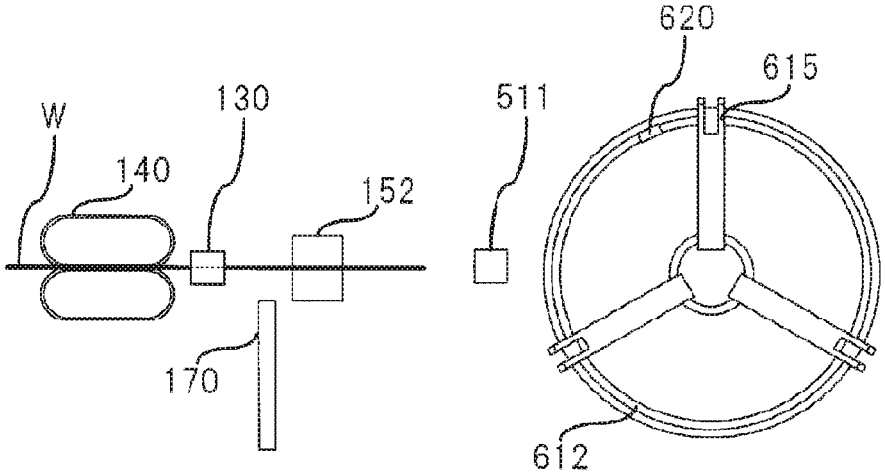

First, as illustrated in FIGS. 32A and 32B, the electric wire feeding mechanism 140 feeds the electric wire W to the extent that the leading end of the electric wire W passes through the second chuck 152 of the electric wire gripping mechanism 150. Additionally, a length L1 of the electric wire W fed by the operation illustrated in FIGS. 32A and 32B is measured.

Figure 33A:
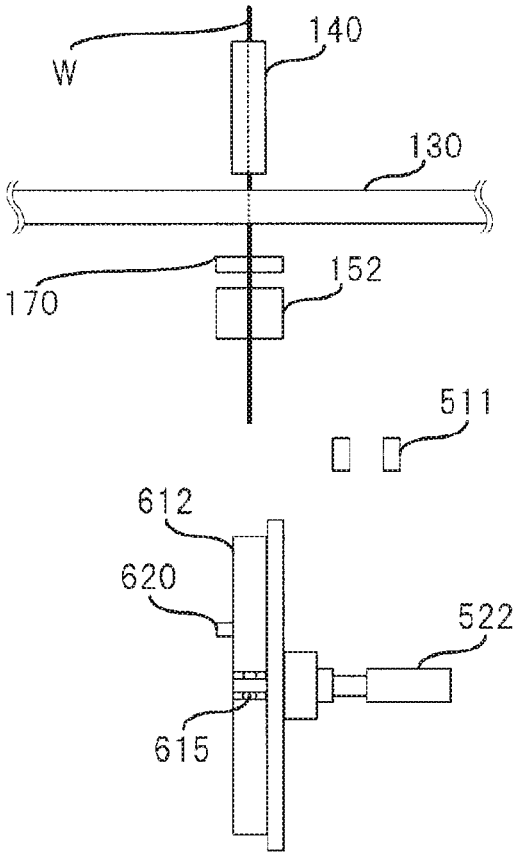
FIGS. 33A and 33B are diagrams schematically depicting an example of an operation of the electric wire processing apparatus according to the embodiment of the invention.
Figure 33B:
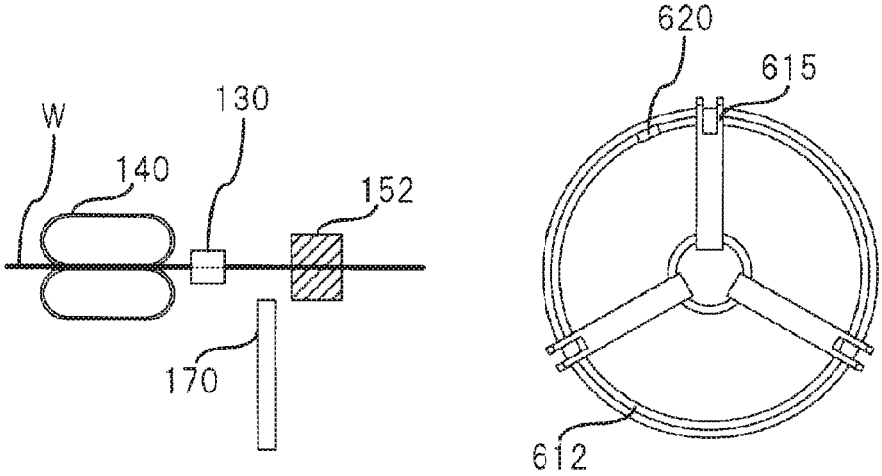

Subsequently, as illustrated in FIGS. 33A and 33B, the second chuck 152 of the electric wire gripping mechanism 150 is closed to grip the electric wire W.

Figure 34A:
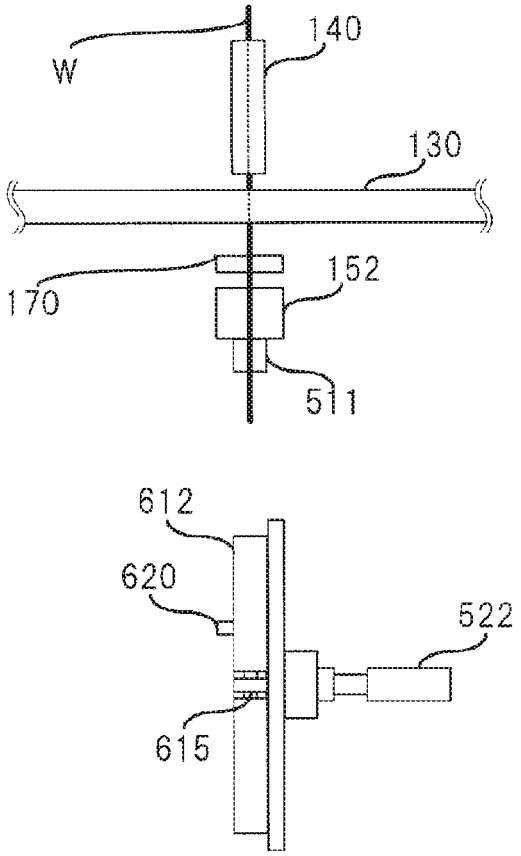
FIGS. 34A and 34B are diagrams schematically depicting an example of an operation of the electric wire processing apparatus according to the embodiment of the invention.
Figure 34B:
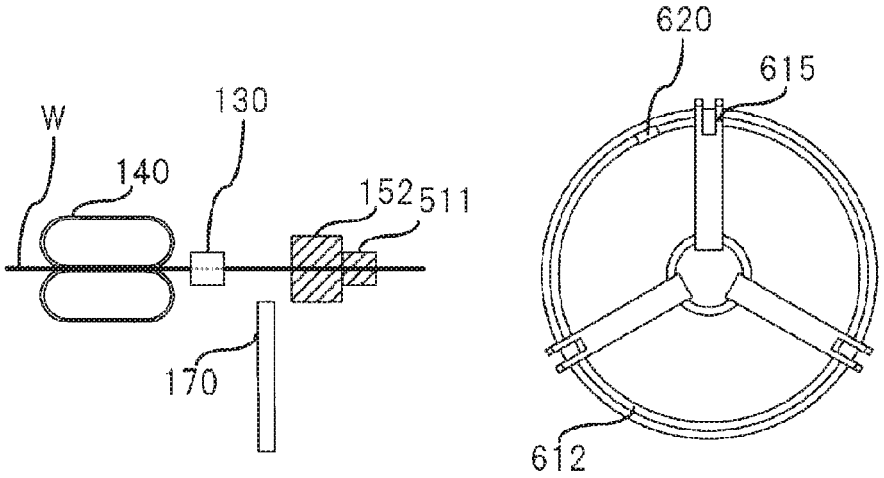

Subsequently, as illustrated in FIGS. 34A and 34B, the manipulator 510 moves the hand 511 adjacently to the electric wire winding mechanism 520 of the second chuck 152, and the hand 511 grips the electric wire gripped by the second chuck 152.

Figure 35A:
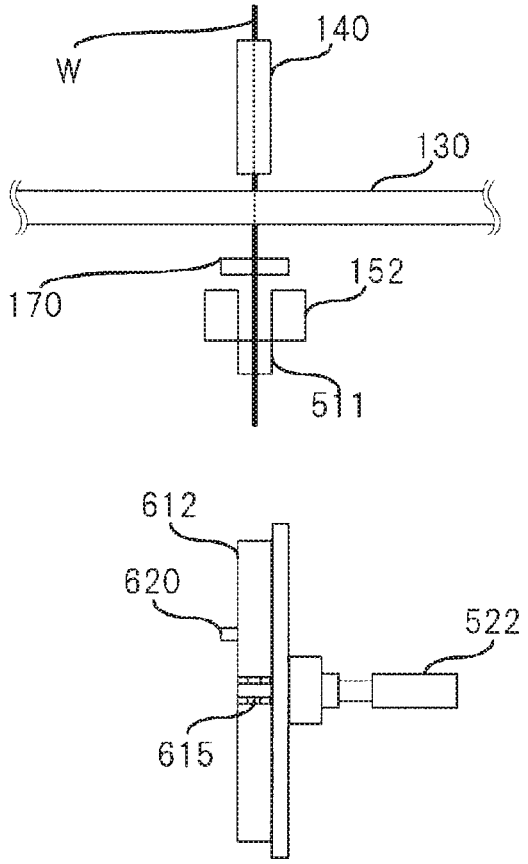
FIGS. 35A and 35B are diagrams schematically depicting an example of an operation of the electric wire processing apparatus according to the embodiment of the invention.
Figure 35B:
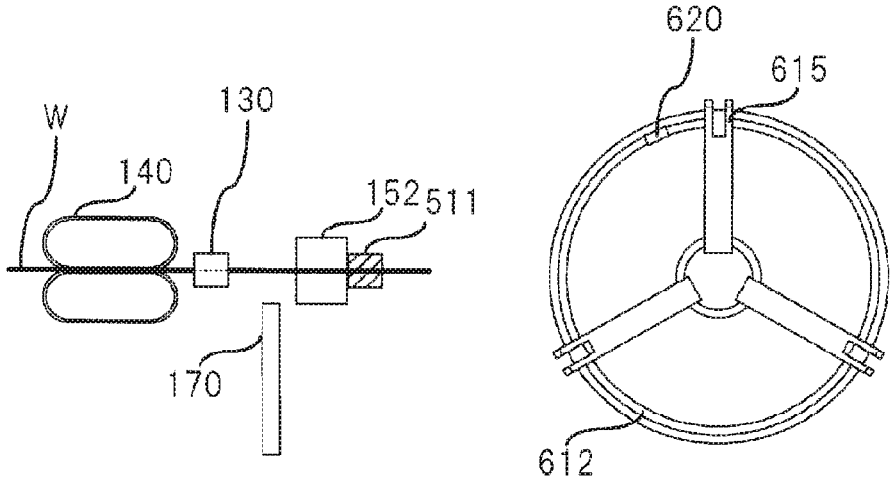

Subsequently, as illustrated in FIGS. 35A and 35B, the second chuck 152 of the electric wire gripping mechanism 150 is opened to release the gripped electric wire V. The "second example of the operation of the electric wire processing apparatus" differs from the "First example of the operation of the electric wire processing apparatus" in that the first chuck 151 of the electric wire gripping mechanism 150 is not involved in the operation. Therefore, the operation of changing the direction of the leading end of the electric wire to the reverse feeding direction from the forward feeding direction is not performed.

Figure 36A:
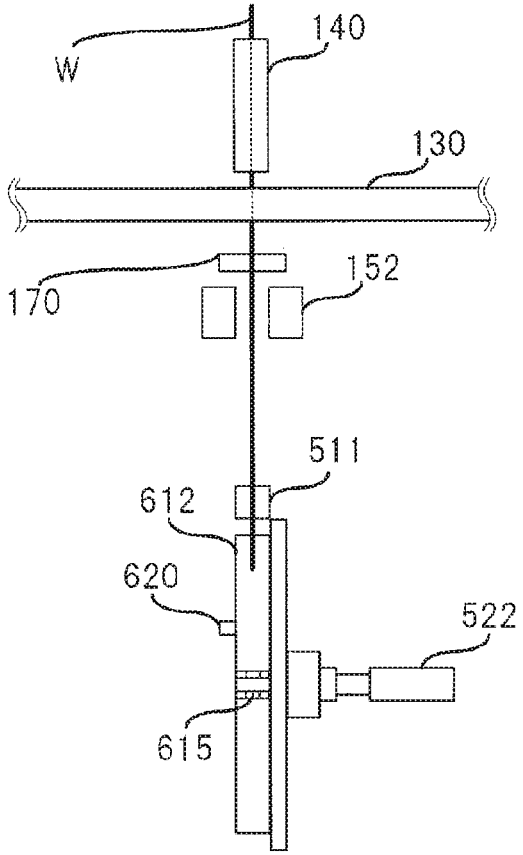
FIGS. 36A and 36B are diagrams schematically depicting an example of an operation of the electric wire processing apparatus according to the embodiment of the invention.
Figure 36B:
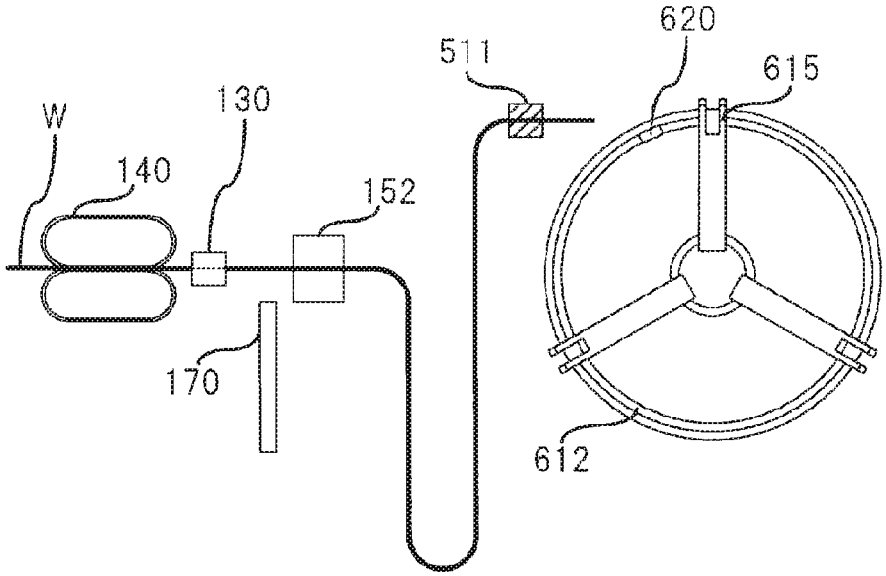

Subsequently, as illustrated in FIGS. 36A and 36B, the manipulator 510 moves the hand 511 to a position adjacent to the winding rib 612 and to the same position as the side where the electric wire cutting device 10 is located. At this time, the hand 511 is located on the straight line through which the electric wire W is fed by the electric wire feeding mechanism 140 when the electric wire processing apparatus 1 is viewed from the top as illustrated in FIG. 36A, and is located at substantially the same height as the height at which the electric wire clip 620 is located when the electric wire processing apparatus 1 is viewed from the side as illustrated in FIG. 36B. Further, as the hand 511 moves, the electric wire feeding mechanism 140 feeds the electric wire W. Additionally, a length L2 of the electric wire W fed by the operation illustrated in FIGS. 36A and 36B is also measured. By the operation of the hand 511 and the electric wire feeding mechanism 140, the electric wire W from the electric wire feeding mechanism 140 to the hand 511 is located on the straight line through which the electric wire W is fed by the electric wire feeding mechanism 140 when the electric wire processing apparatus 1 is viewed from the top as illustrated in FIG. 36A, and the electric wire W extending from the hand 511 is suspended by its own weight so as to draw a U-shape between the electric wire cutting device 10 and the electric wire extracting device 50 when the electric wire processing apparatus 1 is viewed from the side as illustrated in FIG. 36B. With such a positional relation of the electric wire W, the electric wire W wound around the winding rib 612 can be easily collected in the recess portion 619 of the guide plate 615 when the electric wire W is wound around the winding rib 612 by the subsequent operation.

Figure 37A:
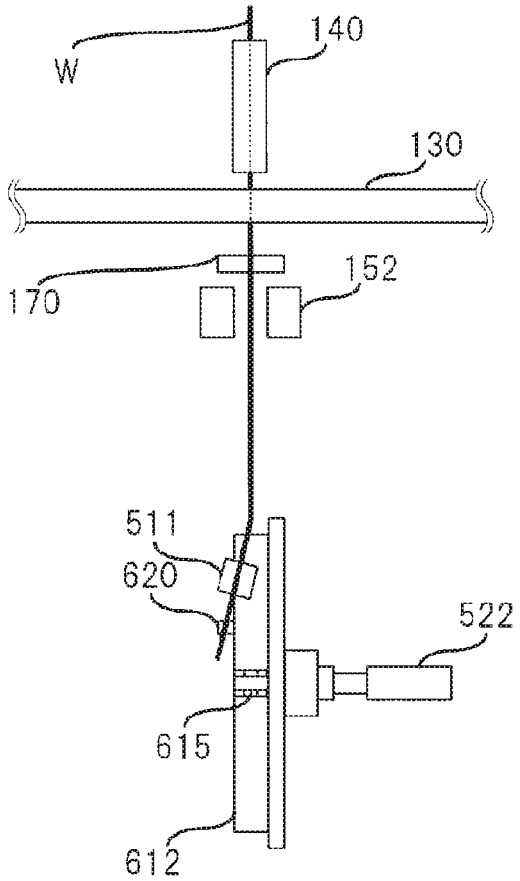
FIGS. 37A and 37B are diagrams schematically depicting an example of an operation of the electric wire processing apparatus according to the embodiment of the invention.
Figure 37B:
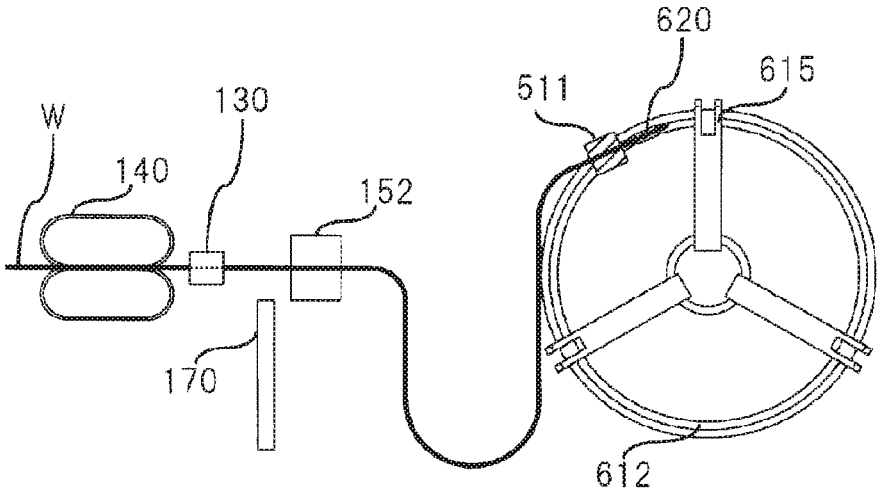

Subsequently, as illustrated in FIGS. 37A and 37B, the manipulator 510 moves the hand 511 adjacently to the electric wire clip 620 provided on the winding drum 521, and thus the leading end of the electric wire W gripped by the hand 511 is pushed between the pair of pinching elements 621 of the electric wire clip 620. At this time, as illustrated in FIG. 37A, the hand 511 is rotated in a yaw direction, and thus a part of the leading end of the electric wire W partially protrudes to the side opposite to the base frame 611 of the winding rib 612. Further, as illustrated in FIG. 37B, the hand 511 is rotated in a pitch direction so that the depth direction of the electric wire clip 620 corresponding to the position of the electric wire clip 620 coincides with the direction in which the leading end of the electric wire W extends (in other words, the pinching direction of the article to be pinched between the pair of pinching elements 621 of the electric wire clip 620 is orthogonal to the direction where the leading end of the electric wire W extends).

Figure 38A:
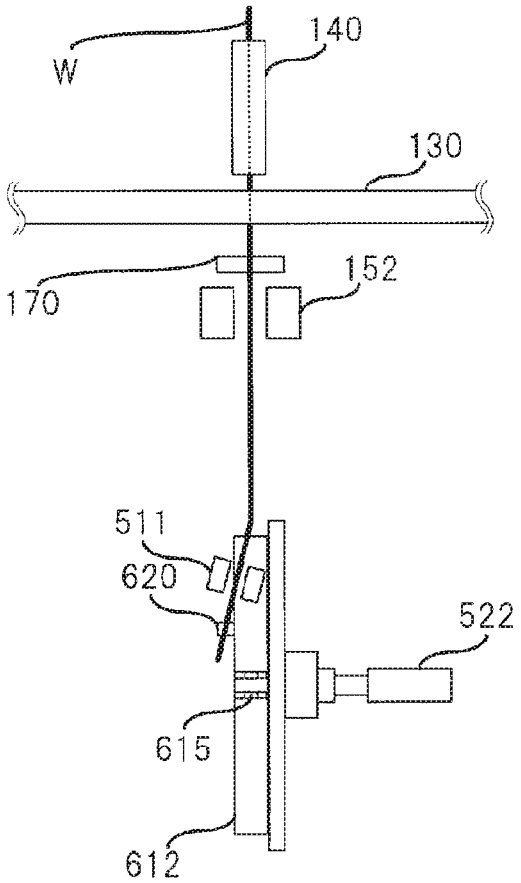
FIGS. 38A and 38B are diagrams schematically depicting an example of an operation of the electric wire processing apparatus according to the embodiment of the invention.
Figure 38B:
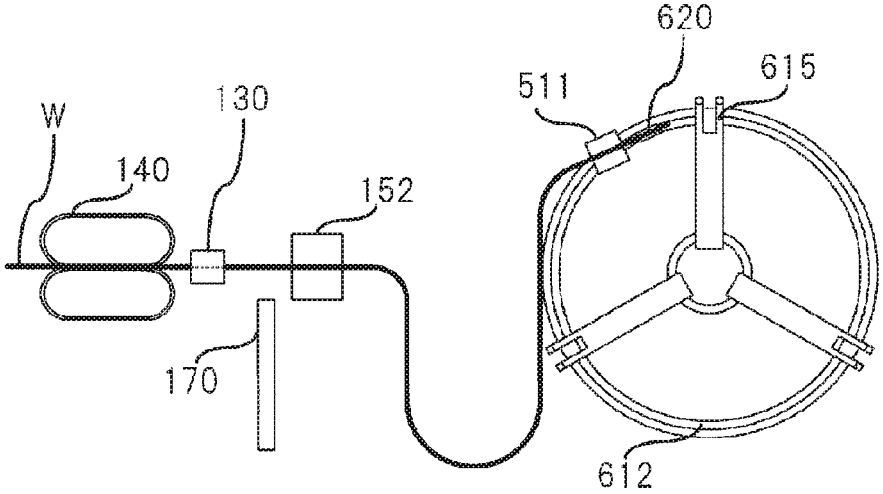

Subsequently, as illustrated in FIGS. 38A and 38B, the manipulator 510 opens the hand 511 to release the electric wire W which is gripped.

Figure 39A:
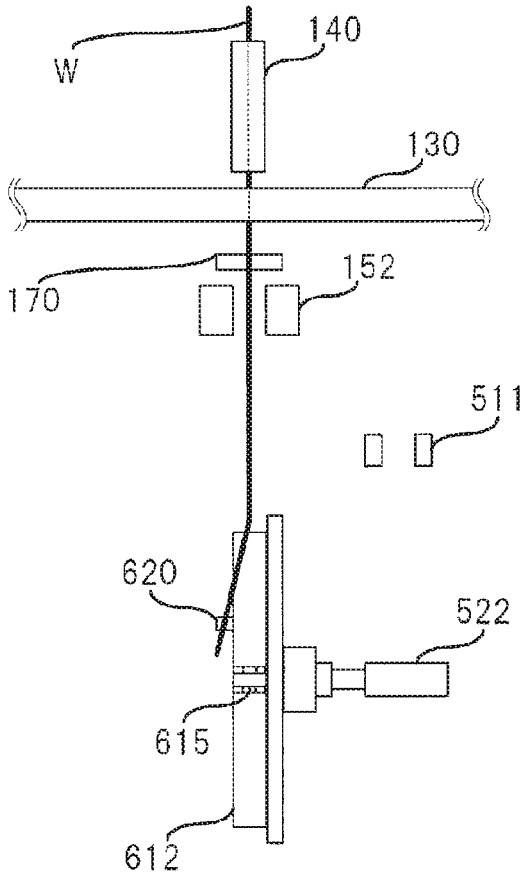
FIGS. 39A and 39B are diagrams schematically depicting an example of an operation of the electric wire processing apparatus according to the embodiment of the invention.
Figure 39B:
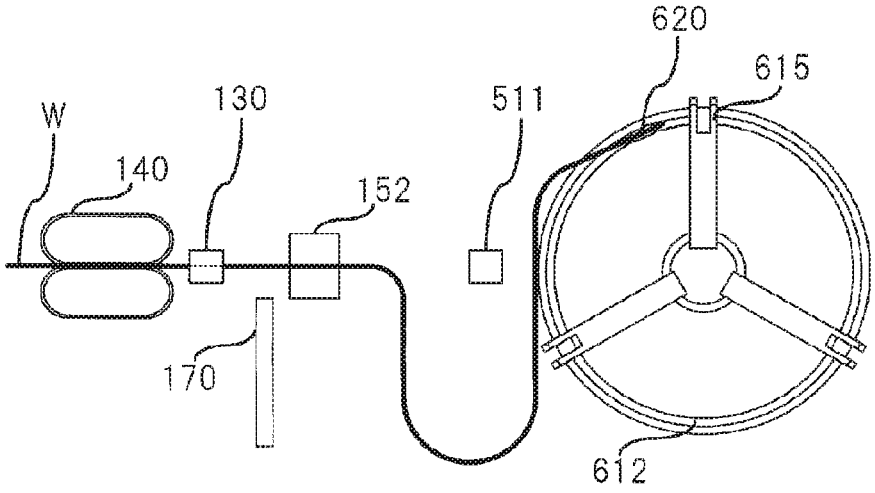

Subsequently, as illustrated in FIGS. 39A and 39B, the manipulator 510 moves the hand 511 to an initial position.

Figure 40A:
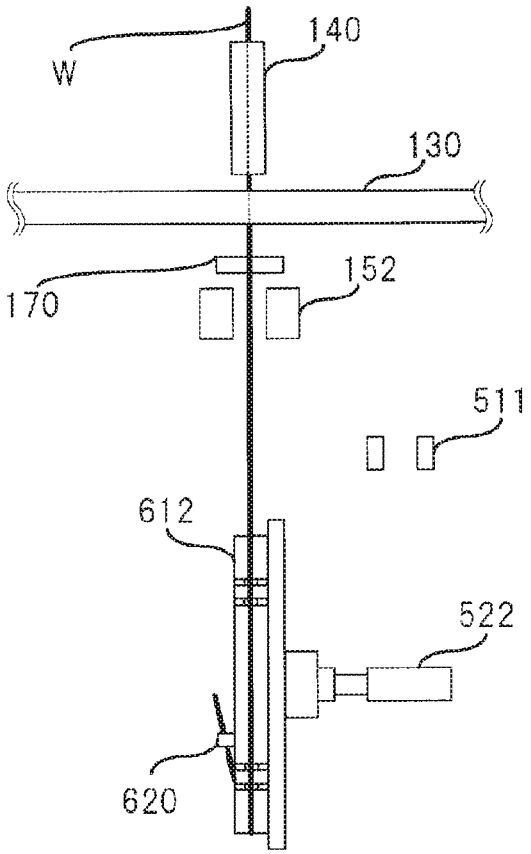
FIGS. 40A and 40B are diagrams schematically depicting an example of an operation of the electric wire processing apparatus according to the embodiment of the invention.
Figure 40B:
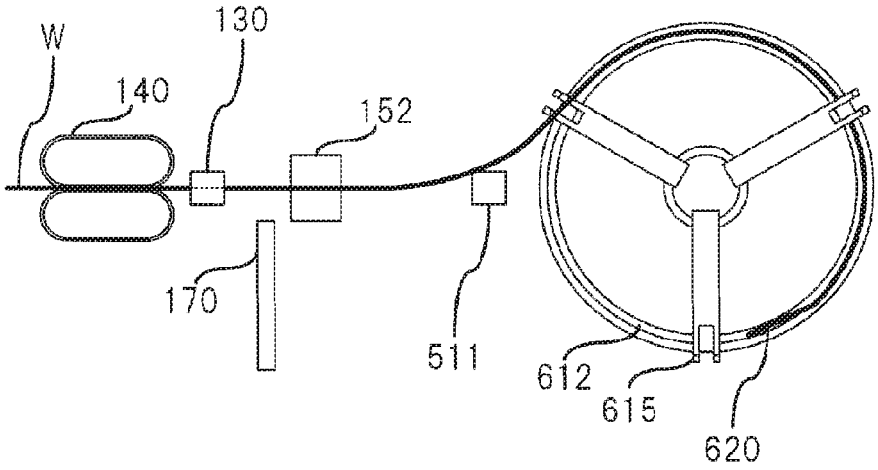

Subsequently, as illustrated in FIGS. 40A and 40B, the electric wire winding mechanism 520 drives the motor 522 to rotate the winding drum 521. The winding drum 521 rotates clockwise in FIG. 40B. During the operation illustrated in FIGS. 40A and 40B, the electric wire feeding mechanism 140 does not feed the electric wire W, so that the electric wire W slackened between the electric wire cutting device 10 and the electric wire extracting device 50 is wound around the winding rib 612 by the rotation of the winding drum 521.

Figure 41A:
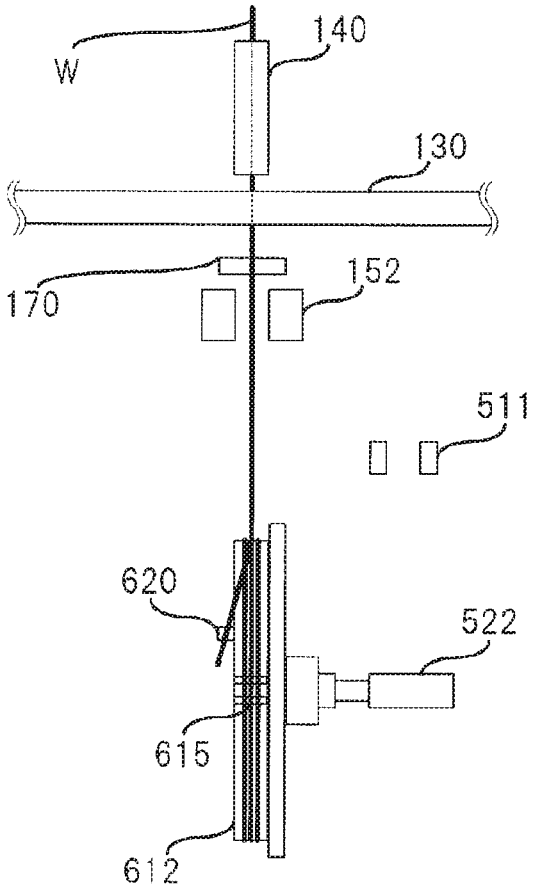
FIGS. 41A and 41B are diagrams schematically depicting an example of an operation of the electric wire processing apparatus according to the embodiment of the invention.
Figure 41B:
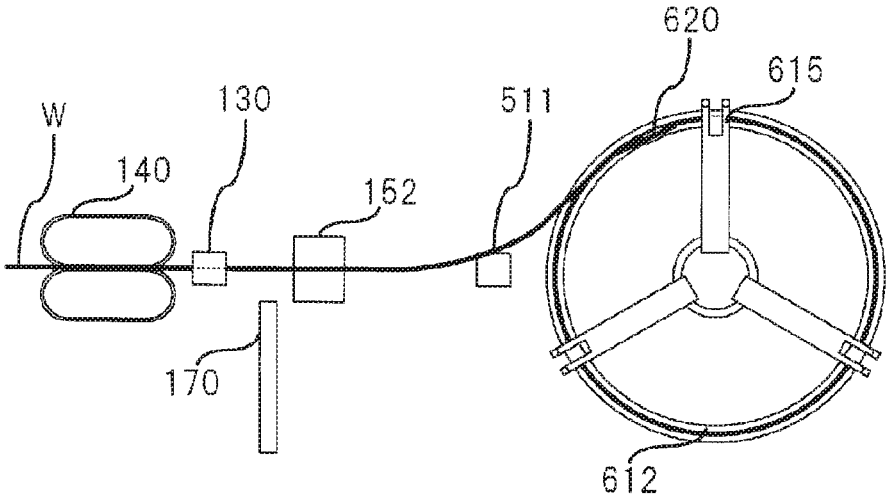

Subsequently, as illustrated in FIGS. 41A and 41B, the electric wire winding mechanism 520 drives the motor 522 to rotate the winding drum 521. During the operation illustrated in FIGS. 41A and 413, the electric wire feeding mechanism 140 feeds the electric wire W. A length L3 of the electric wire W fed by the operation illustrated in FIGS. 41A and 41B is also additionally measured. At this time, the electric wire feeding mechanism 140 controls the amount of electric wire W to be fed and the electric wire winding mechanism 520 controls the number of rotations of the winding drum 521 such that the length of the electric wire W fed by the electric wire feeding mechanism 140 per time is equal to the length of the electric wire W wound around the outer circumferential surface of the winding rib 612 per time. FIGS. 41A and 413 illustrate a state in which the winding drum 521 rotates several times and the electric wire W is wound around the winding rib 612 several times. Thereafter, when the total value of the lengths (L1, L2, and L3) of the electric wire fed in three operations reaches a predetermined length, the electric wire feeding mechanism 140 stops the feeding of the electric wire W, and the electric wire winding mechanism 520 stops the rotation of the winding drum 521.

Figure 42A:
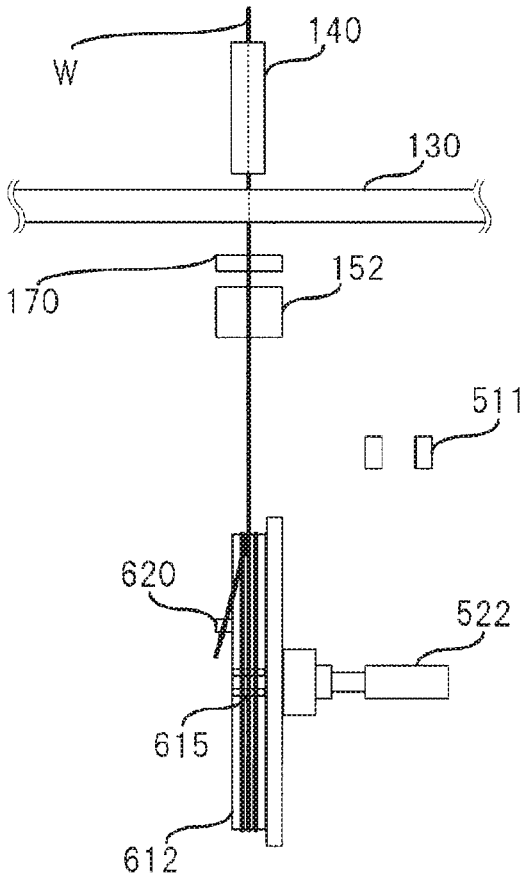
FIGS. 42A and 42B are diagrams schematically depicting an example of an operation of the electric wire processing apparatus according to the embodiment of the invention.
Figure 42B:
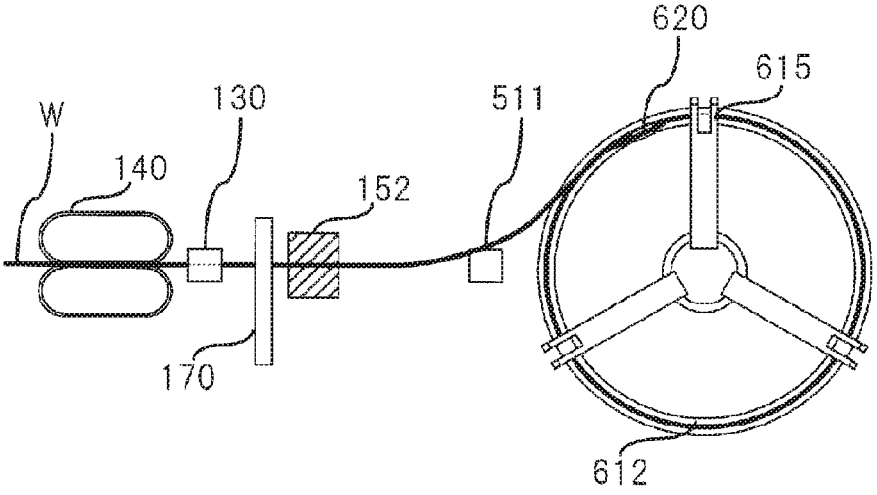

Subsequently, as illustrated in FIGS. 42A and 42B, the second chuck 152 of the electric wire gripping mechanism 150 is closed to grip the electric wire W. Subsequently, the lower blade of the electric wire cutting mechanism 170 approaches the third electric wire guide 130 to cut the electric wire W.

Figure 43A:
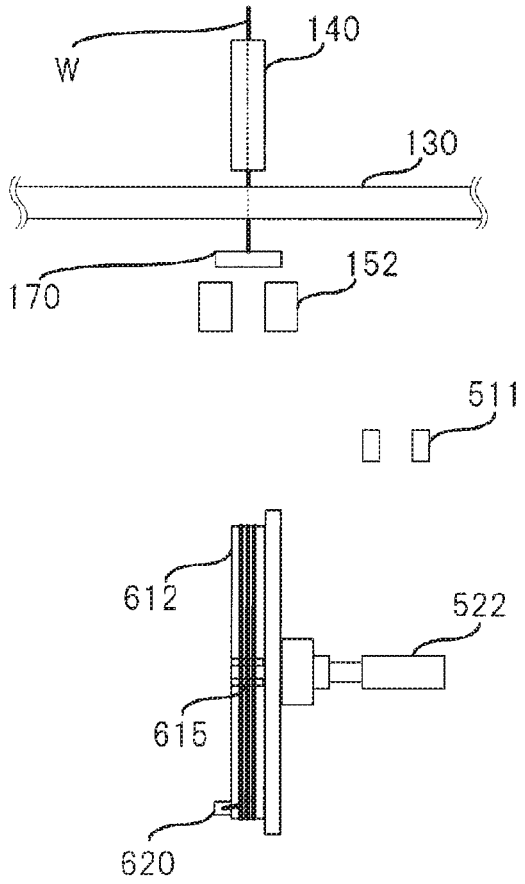
FIGS. 43A and 43B are diagrams schematically depicting an example of an operation of the electric wire processing apparatus according to the embodiment of the invention.
Figure 43B:
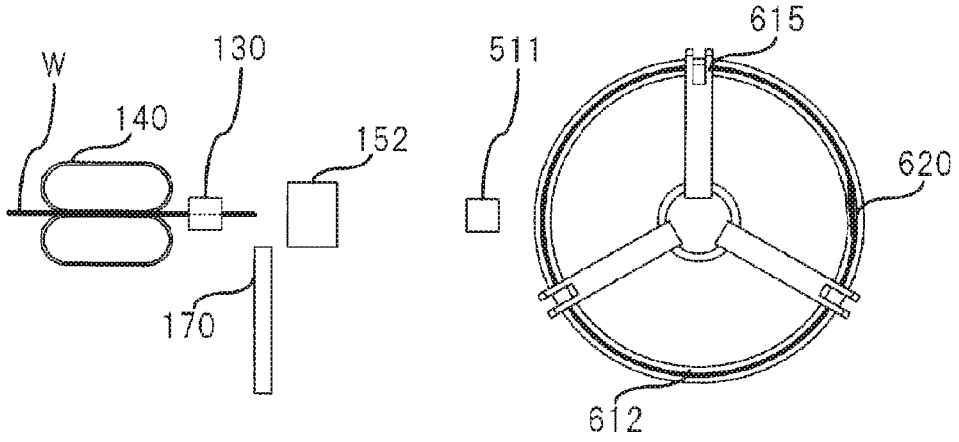

Subsequently, as illustrated in FIGS. 43A and 43B, the second chuck 152 of the electric wire gripping mechanism 150 is opened to release the gripped electric wire W. Subsequently, the electric wire winding mechanism 520 drives the motor 522 to rotate the winding drum 521. During the operation illustrated in FIGS. 43A and 43B, the electric wire feeding mechanism 140 does not feed the electric wire W. The other end of the electric wire W gripped by the second chuck 152 of the electric wire gripping mechanism 150 in FIGS. 42A and 42B is wound around the winding rib 612 by the rotation of the winding drum 521. Thus, as illustrated in FIGS. 43A and 43B, the total extension length of the electric wire W cut into a predetermined length is wound around the winding rib 612.

Thereafter, similarly to the operation described with reference to FIGS. 29A to 30B in the "first example of the operation of the electric wire processing apparatus", three clamps 630 are attached to the annular electric wire bundle C wound around the winding rib 612, the leading end of the electric wire is detached from the electric wire clip 620, and the annular electric wire bundle C is removed from the winding rib 612. Thus, as illustrated in FIG. 13, the clamps 630 holds three points of the electric wire bundle C formed in an annular shape by the winding of one electric wire, and thus the annular electric wire bundle C is maintained in a state of the annular shape.

As described above with reference to FIGS. 31A to 43B, the electric wire processing apparatus according to the embodiment of the invention processes one electric wire W into the electric wire holding structure 700. According to the electric wire holding structure 700, even in the case of manufacturing a wire harness using a long electric wire longer than a normal length, there is no need for the worker to deform the electric wire to have a shape and a size suitable for conveying the long electric wire to an automatic machine which processes the electric wire. Further, since the shape of the electric wire holding structure 700 is maintained in the annular shape, the electric wire holding structure 700 may be conveyed to the automatic machine for processing the electric wire by being hung on a hook, and thus the conveyance of the electric wire holding structure 700 is also easily automated. Thus, according to the electric wire processing apparatus and the electric wire processing method of the embodiment of the invention, and the electric wire holding structure used in the electric wire processing apparatus and the electric wire processing method, it is possible to obtain an excellent effect of contributing to improvement in productivity when the long electric wire is conveyed to the automatic machine for processing the electric wire.

Here, the characteristics of the electric wire processing apparatus, the electric wire processing method, and the electric wire holding structure of the above-described embodiment according to the invention will be collectively exemplified in brief by following [1] to [12].

[1] An electric wire processing apparatus (1) including:

a gripping mechanism (a first chuck 151 and a hand 511) capable of gripping a part of an electric wire (W);

a driving mechanism (a rotating mechanism 160 and a motor 512) that drives the gripping mechanism;

an electric wire winding mechanism (520) that winds the electric wire; and a rotating mechanism (a motor 522) that rotates and drives the electric wire winding mechanism, wherein the electric wire winding mechanism includes a winding drum (521) on which the electric wire is wound, an electric wire clip (620) provided on the winding drum to hold a leading end of the electric wire, and a holding member (a clamp 630) that holds an electric wire bundle wound around the winding drum in an annular shape, the driving mechanism moves the gripping mechanism, which grips the leading end of the electric wire, toward the electric wire clip to hold the leading end on the electric wire clip, the rotating mechanism rotates the winding drum in a state where the leading end of the electric wire is held on the electric wire clip so that the electric wire is wound around the winding drum; and the holding member holds the electric wire bundle wound around the winding drum in the annular shape.

[2] The electric wire processing apparatus according to [1], further including:

an electric wire cutting device (10) that cuts the electric wire to a predetermined length and feeds the cut electric wire; an an electric wire extracting device (50) that receives the electric wire fed from the electric wire cutting device, wherein the electric wire cutting device includes a first gripping mechanism (the first chuck 151) serving as the gripping mechanism, the electric wire extracting device includes a second gripping mechanism (the hand 511) serving as the gripping mechanism, a second driving mechanism (the motor 512) that drives the second gripping mechanism and serves as the driving mechanism, the electric wire winding mechanism, and the rotating mechanism, the first gripping mechanism grips the leading end of the electric wire fed by the electric wire cutting device when the leading end is fed, the second gripping mechanism grips the leading end and receives the electric wire when the first gripping mechanism grips the leading end of the electric wire, and the second driving mechanism moves the second gripping mechanism, which grips the leading end of the electric wire, toward the electric wire clip to hold the leading end on the electric wire clip.

[3] The electric wire processing apparatus according to [2], wherein the electric wire cutting device further includes a first driving mechanism (the rotating mechanism 160) that drives the first gripping mechanism and serves as the driving mechanism, and the first driving mechanism drives the first gripping mechanism so that a direction of the leading end of the electric wire gripped by the first gripping mechanism is reversed from a forward feeding direction to a reverse feeding direction.

[4] The electric wire processing apparatus according to any one of [1] to [3], wherein the winding drum includes a hollow cylindrical body (a winding rib 612) around which the electric wire is wound, the cylindrical body is provided with a notch (613) which is recessed downward in an axial direction from an upper end in the axial direction, and the electric wire clip is accommodated and attached in the notch so that an electric wire pinching direction coincides with a radial direction of the cylindrical body.

[5] The electric wire processing apparatus according to [4], wherein the driving mechanism rotates the gripping mechanism, which grips the leading end of the electric wire, to be in a state where the leading end of the electric wire is inclined with respect to a plane orthogonal to the axial direction of the cylindrical body, and moves the gripping mechanism toward the electric wire clip.

[6] The electric wire processing apparatus according to [4], wherein the driving mechanism rotates the gripping mechanism, which grips the leading end of the electric wire, to be in a state where the electric wire pinching direction of the electric wire clip is orthogonal to a direction in which the leading end of the electric wire extends, and moves the gripping mechanism toward the electric wire clip.

[7] An electric wire processing method including:

moving a gripping mechanism (a first chuck 151 and a hand 511), which grips a leading end of an electric wire (W), toward an electric wire clip (620) for holding the leading end of the electric wire to hold the leading end on the electric wire clip;

rotating a winding drum (521), on which the electric wire clip is provided, in a state where the leading end of the electric wire is held on the electric wire clip so that the electric wire is wound around the winding drum; and attaching a holding member (a clamp 630) to an electric wire bundle (C) wound around the winding drum in the annular shape.

[8] The electric wire processing method according to [7], further including:

gripping the leading end of the electric wire fed by an electric wire cutting device (10), using a first gripping mechanism (the first chuck 151) serving as the gripping mechanism included in the electric wire cutting device that cuts the electric wire to a predetermined length and feeds the cut electric wire, when the leading end is fed;

gripping the leading end and receives the electric wire, using a second gripping mechanism (the hand 511) serving as the gripping mechanism included in an electric wire extracting device (50) that receives the electric wire fed from the electric wire cutting device, when the first gripping mechanism grips the leading end of the electric wire; and moving the second gripping mechanism, which grips the leading end of the electric wire, toward the electric wire clip to hold the leading end on the electric wire clip.

[9] The electric wire processing method according to [8], wherein the first gripping mechanism is driven so that a direction of the leading end of the electric wire gripped by the first gripping mechanism is reversed from a forward feeding direction to a reverse feeding direction.

[10] The electric wire processing method according to any one of [7] to [9], wherein the winding drum includes a hollow cylindrical body (a winding rib 612) around which the electric wire is wound, the cylindrical body is provided with a notch (613) which is recessed downward in an axial direction from an upper end in the axial direction, and the electric wire clip is accommodated and attached in the notch, and the gripping mechanism, which grips the leading end of the electric wire, is rotated to be in a state where the leading end of the electric wire is inclined with respect to a plane orthogonal to the axial direction of the cylindrical body, and the gripping mechanism is moved toward the electric wire clip.

[11] The electric wire processing method according to any one of [7] to [9], wherein the winding drum includes a hollow cylindrical body (a winding rib 612) around which the electric wire is wound, the cylindrical body is provided with a notch (613) which is recessed downward in an axial direction from an upper end in the axial direction, and the electric wire clip is accommodated and attached in the notch, and the gripping mechanism, which grips the leading end of the electric wire, is rotated to be in a state where an electric wire pinching direction of the electric wire clip is orthogonal to a direction in which the leading end of the electric wire extends, and the gripping mechanism is moved toward the electric wire clip.

[12] An electric wire holding structure (700) including:

an electric wire (W); and a holding member (a clamp 630) that holds an electric wire bundle (C), wherein the electric wire is wound several times to form an annular shape, and is held by the holding member to maintain the annular shape.

[13] The electric wire holding structure according to [12], wherein the electric wire is held at three or more places by the holding member to maintain the annular shape.

What is claimed is:

1. An electric wire processing apparatus comprising:

a gripping mechanism that is capable of gripping a part of an electric wire;

a driving mechanism that drives the gripping mechanism;

an electric wire winding mechanism that winds the electric wire; and a rotating mechanism that rotates and drives the electric wire winding mechanism, wherein:

the electric wire winding mechanism includes:

a winding drum on which the electric wire is wound, an electric wire clip provided on the winding drum to hold a leading end of the electric wire, and a holding member that holds an electric wire bundle wound around the winding drum in an annular shape, the driving mechanism moves the gripping mechanism, which grips the leading end of the electric wire, toward the electric wire clip to hold the leading end on the electric wire clip, the rotating mechanism rotates the winding drum in a state where the leading end of the electric wire is held on the electric wire clip so that the electric wire is wound around the winding drum, the holding member holds the electric wire bundle wound around the winding drum in the annular shape, the winding drum includes a hollow cylindrical body around which the electric wire is wound, the cylindrical body is provided with a notch which is recessed downward in an axial direction of the cylindrical body from an upper end of the cylindrical body in the axial direction, and the electric wire clip is accommodated and attached in the notch so that an electric wire pinching direction coincides with a radial direction of the cylindrical body.

2. The electric wire processing apparatus according to claim 1, further comprising:

an electric wire cutting device that cuts the electric wire to a predetermined length and feeds the cut electric wire; and an electric wire extracting device that receives the electric wire fed from the electric wire cutting device, wherein the electric wire cutting device includes a first gripping mechanism serving as the gripping mechanism, the electric wire extracting device includes a second gripping mechanism serving as the gripping mechanism, a second driving mechanism that drives the second gripping mechanism and serves as the driving mechanism, the electric wire winding mechanism, and the rotating mechanism, the first gripping mechanism grips the leading end of the electric wire fed by the electric wire cutting device when the leading end is fed, the second gripping mechanism grips the leading end and receives the electric wire when the first gripping mechanism grips the leading end of the electric wire, and the second driving mechanism moves the second gripping mechanism, which grips the leading end of the electric wire, toward the electric wire clip to hold the leading end on the electric wire clip.

3. The electric wire processing apparatus according to claim 2, wherein the electric wire cutting device further includes a first driving mechanism that drives the first gripping mechanism and serves as the driving mechanism, and the first driving mechanism drives the first gripping mechanism so that a direction of the leading end of the electric wire gripped by the first gripping mechanism is reversed from a forward feeding direction of the electric wire cutting device to a reverse feeding direction of the electric wire cutting device.

4. The electric wire processing apparatus according to claim 1, wherein the driving mechanism rotates the gripping mechanism, which grips the leading end of the electric wire, to be in a state where the leading end of the electric wire is inclined with respect to a plane orthogonal to the axial direction of the cylindrical body, and moves the gripping mechanism toward the electric wire clip.

5. The electric wire processing apparatus according to claim 1, wherein the driving mechanism rotates the gripping mechanism, which grips the leading end of the electric wire, to be in a state where the electric wire pinching direction of the electric wire clip is orthogonal to a direction in which the leading end of the electric wire extends, and moves the gripping mechanism toward the electric wire clip.

6. An electric wire processing method comprising:

moving a gripping mechanism, which grips a leading end of an electric wire, toward an electric wire clip for holding the leading end of the electric wire to hold the leading end on the electric wire clip;

rotating a winding drum, on which the electric wire clip is provided, in a state where the leading end of the electric wire is held on the electric wire clip so that the electric wire is wound around the winding drum; and attaching a holding member to an electric wire bundle wound around the winding drum in an annular shape, wherein:

the winding drum includes a hollow cylindrical body around which the electric wire is wound, the cylindrical body is provided with a notch which is recessed downward in an axial direction from an upper end in the axial direction, and the electric wire clip is accommodated and attached in the notch, and the gripping mechanism, which grips the leading end of the electric wire, is rotated to be in a state where an electric wire pinching direction of the electric wire clip is orthogonal to a direction in which the leading end of the electric wire extends, and the gripping mechanism is moved toward the electric wire clip.

7. The electric wire processing method according to claim 6, further comprising:

gripping the leading end of the electric wire fed by an electric wire cutting device, using a first gripping mechanism serving as the gripping mechanism included in the electric wire cutting device that cuts the electric wire to a predetermined length and feeds the cut electric wire, when the leading end is fed;

gripping the leading end and receives the electric wire, using a second gripping mechanism serving as the gripping mechanism included in an electric wire extracting device that receives the electric wire fed from the electric wire cutting device, when the first gripping mechanism grips the leading end of the electric wire; and moving the second gripping mechanism, which grips the leading end of the electric wire, toward the electric wire clip to hold the leading end on the electric wire clip.

8. The electric wire processing method according to claim 7, wherein the first gripping mechanism is driven so that a direction of the leading end of the electric wire gripped by the first gripping mechanism is reversed from a forward feeding direction of the electric wire cutting device to a reverse feeding direction of the electric wire cutting device.

9. The electric wire processing method according to claim 6, wherein the winding drum includes a hollow cylindrical body around which the electric wire is wound, the cylindrical body is provided with a notch which is recessed downward in an axial direction from an upper end in the axial direction, and the electric wire clip is accommodated and attached in the notch, and the gripping mechanism, which grips the leading end of the electric wire, is rotated to be in a state where the leading end of the electric wire is inclined with respect to a plane orthogonal to the axial direction of the cylindrical body, and the gripping mechanism is moved toward the electric wire clip.

* * * * *